US010750593B1

(12) United States Patent
Hashimoto et al.

(10) Patent No.: US 10,750,593 B1
(45) Date of Patent: Aug. 18, 2020

(54) DRIVING CIRCUITS

(71) Applicant: InnoLux Corporation, Miao-Li County (TW)

(72) Inventors: Kazuyuki Hashimoto, Miao-Li County (TW); Hidetoshi Watanabe, Miao-Li County (TW); Ming-Chun Tseng, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/713,116

(22) Filed: Dec. 13, 2019

Related U.S. Application Data

(60) Provisional application No. 62/833,807, filed on Apr. 15, 2019.

(51) Int. Cl.

| | |
|---|---|
| ***H05B 37/02*** | (2006.01) |
| ***H05B 45/325*** | (2020.01) |
| ***G09G 3/32*** | (2016.01) |
| *H05B 45/00* | (2020.01) |
| *H05B 47/11* | (2020.01) |
| *H05B 45/10* | (2020.01) |

(52) U.S. Cl.
CPC ..... *H05B 45/325* (2020.01); *G09G 3/32* (2013.01); *G09G 2310/0264* (2013.01); *G09G 2310/0272* (2013.01); *G09G 2310/0291* (2013.01); *G09G 2310/08* (2013.01); *H05B 45/10* (2020.01); *H05B 45/60* (2020.01); *H05B 47/11* (2020.01)

(58) Field of Classification Search
CPC ..... H05B 45/10; H05B 45/325; H05B 47/11; G09G 2310/0272; G09G 2310/0264
See application file for complete search history.

(56) References Cited

U.S. PATENT DOCUMENTS

| | | | | |
|---|---|---|---|---|
| 9,867,242 | B1 * | 1/2018 | Gao | H05B 45/46 |
| 2015/0137700 | A1 * | 5/2015 | Evans | H05B 45/46 315/294 |
| 2017/0330509 | A1 * | 11/2017 | Cok | G05D 23/021 |
| 2018/0308418 | A1 * | 10/2018 | Scenini | H05B 45/10 |

* cited by examiner

*Primary Examiner* — Thuy Vinh Tran
(74) *Attorney, Agent, or Firm* — McClure, Qualey & Rodack, LLP

(57) ABSTRACT

A driving circuit for illuminating a light emitting unit is provided. The driving circuit includes a data memory circuit, a current source, a PWM control circuit, a buffer circuit, and a second switch. The data memory circuit stores a data signal according to a scan signal. The current source generates a driving current. The PWM control circuit generates a PWM signal according to an enable signal and the data signal stored in the data memory circuit. The buffer circuit receives the PWM signal to generate a PWM signal. The second switch passes the current source through the light emitting unit according to the PWM signal so that the driving current flows through the light emitting unit.

20 Claims, 17 Drawing Sheets

DRIVING CIRCUITS

CROSS REFERENCE TO RELATED APPLICATIONS

This application claims the benefit of U.S. Provisional Application No. 62/833,807, filed on Apr. 15, 2019, the entirety of which is incorporated by reference herein.

BACKGROUND

Field

The disclosure relates generally to circuits for driving light emitting units, and more particularly it relates to circuits for dimming the luminance of the light emitting units with pulse-width modulation (PWM).

Description of the Related Art

An electronic device with light emitting units equips a driver to control the luminance of the light emitting units. A PWM (Pulse Width Modulation) driving method with fixed optimum current has been proposed to drive the light emitting units of the electronic device.

SUMMARY

In an embodiment, a driving circuit for illuminating a light emitting unit is provided. The driving circuit includes a data memory circuit, a current source, a PWM control circuit, a buffer circuit, and a second switch. The data memory circuit receives a data signal. The current source generates a driving current. The PWM control circuit generates a PWM signal. The PWM control circuit comprises a plurality of first switches. The buffer circuit generates a PWM signal according to the PWM control signal. The second switch couples the current source through the light emitting unit according to the PWM signal.

A detailed description is given in the following embodiments with reference to the accompanying drawings.

BRIEF DESCRIPTION OF DRAWINGS

The disclosure can be more fully understood by reading the subsequent detailed description and examples with references made to the accompanying drawings, wherein.

DETAILED DESCRIPTION OF THE DISCLOSURE

Figure 1:
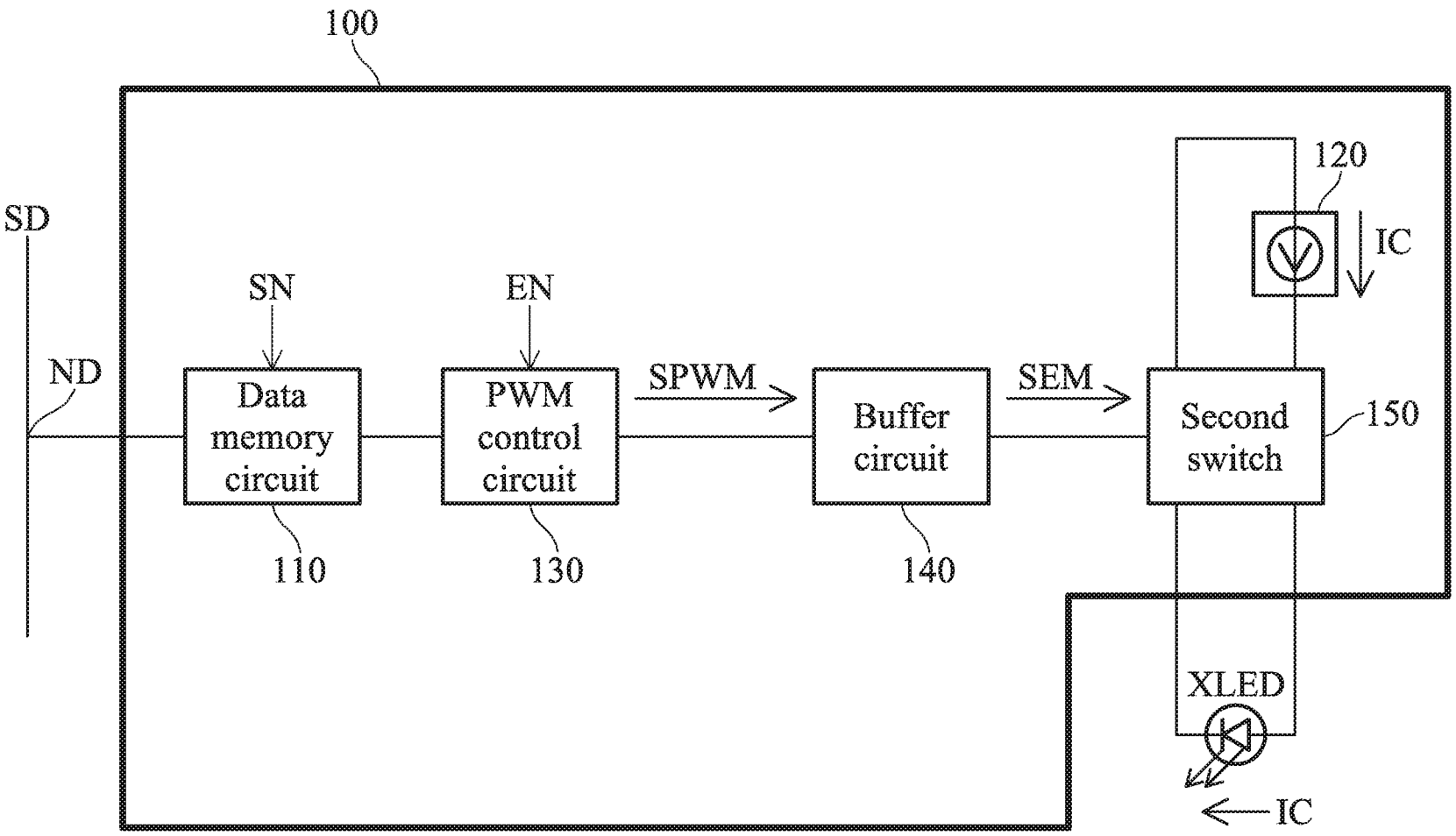
FIG. 1 is a block diagram of a driving circuit in accordance with an embodiment of the disclosure.

This description is made for the purpose of illustrating the general principles of the disclosure and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the disclosure is best determined by reference to the appended claims.

It is understood that the following disclosure provides many different embodiments, or examples, for implementing different features of the application. Specific examples of components and arrangements are described below to simplify the present disclosure. These are, of course, merely examples and will not be intended to be limiting. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of a driving circuit in accordance with an embodiment of the disclosure. As shown in FIG. 1, the driving circuit 100 is configured to illuminate the light emitting unit XLED, which includes a data memory circuit 110, a current source 120, a PWM control circuit 130, a buffer circuit 140, and a second switch 150. It should be noted that the light emitting unit may be a LED (light emitting diode), such as inorganic LED, organic LED (OLED), mini-LED, micro-LED, quantum dot LED (QLED/QD-LED). But the type of the light emitting unit in this disclosure is not limited thereto.

According to an embodiment of the disclosure, the driving circuit 100 may include a plurality of transistors implemented by P-type transistors. According to another embodiment of the disclosure, the driving circuit 100 may include a plurality of transistors implemented by N-type transistors. In other words, the driving circuit 100 may be implemented by either P-type transistors or N-type transistors. When all the transistors related to the light emitting units in the electronic device are P-type transistors or N-type transistors, these transistors can be made in the same processes, and the overall manufacturing processes and cost can be reduced.

The data memory circuit 110 stores the data signal SD passing through the data node ND according to scan signals SN. The current source 120 generates a driving current IC. The PWM control circuit 130 generates a PWM control signal SPWM according to enable signals EN and the data signal SD stored in the data memory circuit 110. The buffer circuit 140 receives the PWM control signal SPWM to generate a PWM signal SEM. The second switch 150 passes the driving current IC through the light emitting unit XLED according to the PWM signal SEM so that a driving current IC flows through the light emitting unit XLED, then the light emitting unit XLED emits light.

Figure 2:
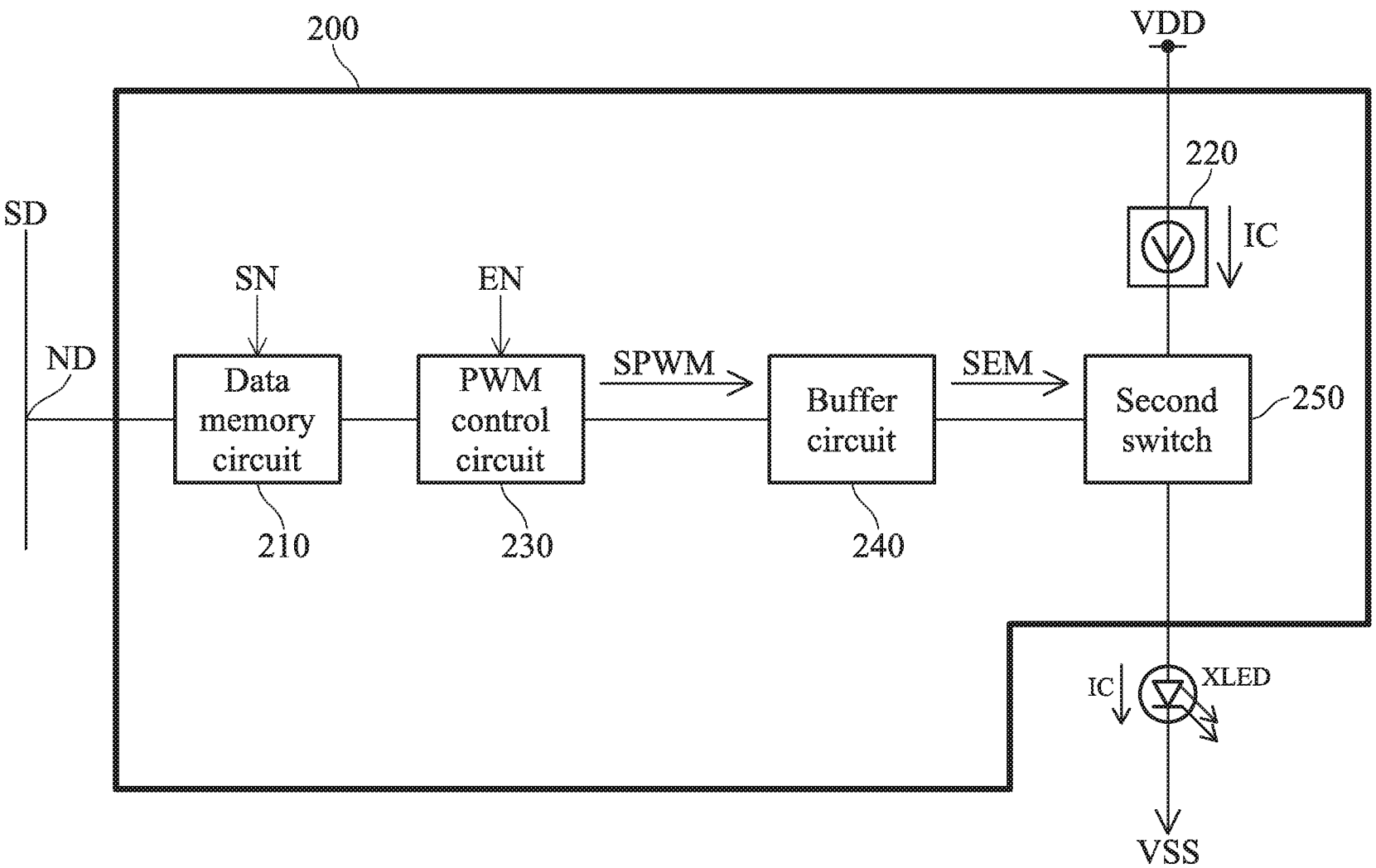
FIG. 2 is a block diagram of a driving circuit in accordance with an embodiment of the disclosure.

FIG. 2 is a block diagram of a driving circuit in accordance with an embodiment of the disclosure, in which the driving circuit 200 in FIG. 2 includes a plurality of transistors implemented by P-type transistors. Like FIG. 1, the driving circuit 200 in FIG. 2 also includes a data memory circuit 210, a current source 220, a PWM control circuit 230, a buffer circuit 240, and a second switch 250. The difference between FIG. 1 and FIG. 2 is that the driving circuit 200 controls a driving current IC flowing through the light emitting unit XLED from the supply voltage VDD.

Figure 3:
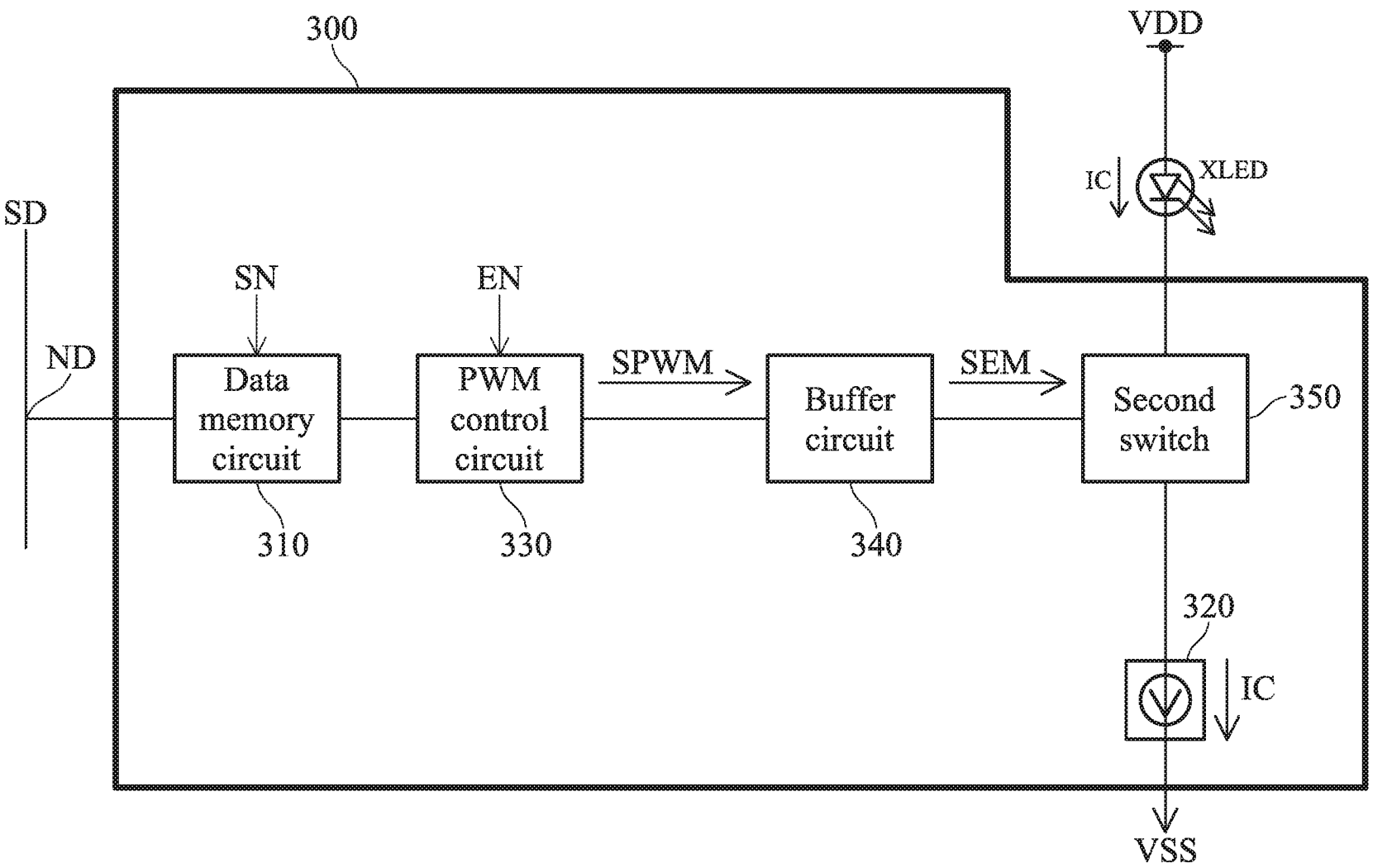
FIG. 3 is a block diagram of a driving circuit in accordance with an embodiment of the disclosure.

FIG. 3 is a block diagram of a driving circuit in accordance with another embodiment of the disclosure, in which the driving circuit in FIG. 3 includes a plurality of transistors implemented by N-type transistors. Like FIG. 1 or FIG. 2, the driving circuit 300 in FIG. 3 includes a data memory circuit 310, a current source 320, a PWM control circuit 330, a buffer circuit 340, and a second switch 350. The difference between FIG. 2 and FIG. 3 is that the driving circuit 300 in FIG. 3 electrically connects between the light emitting unit XLED and the ground level VSS, and the driving circuit 200 in FIG. 2 electrically connects between the light emitting unit XLED and the supply voltage VDD.

According to an embodiment of the disclosure, the data signal SD includes N bits, in which N is a positive integer. Thus, the data memory circuit 210 in FIG. 2 or the data memory circuit 310 in FIG. 3 includes N data memory units. Each of the data memory units stores a corresponding bit of the data signal SD.

It should be noted that the driving circuits with all P-type transistors appear in most embodiments of the disclosure, but they are merely exemplary, and the disclosure is not limited thereto. Since N-type transistors and P-type transistors are complementary, one skilled in the art will understand how to modify the embodiments of the driving circuit with P-type transistors provided as follows to obtain a driving circuit with N-type transistors. In other embodiments, the driving circuit may comprise both N-type and P-type transistors.

Figure 4:
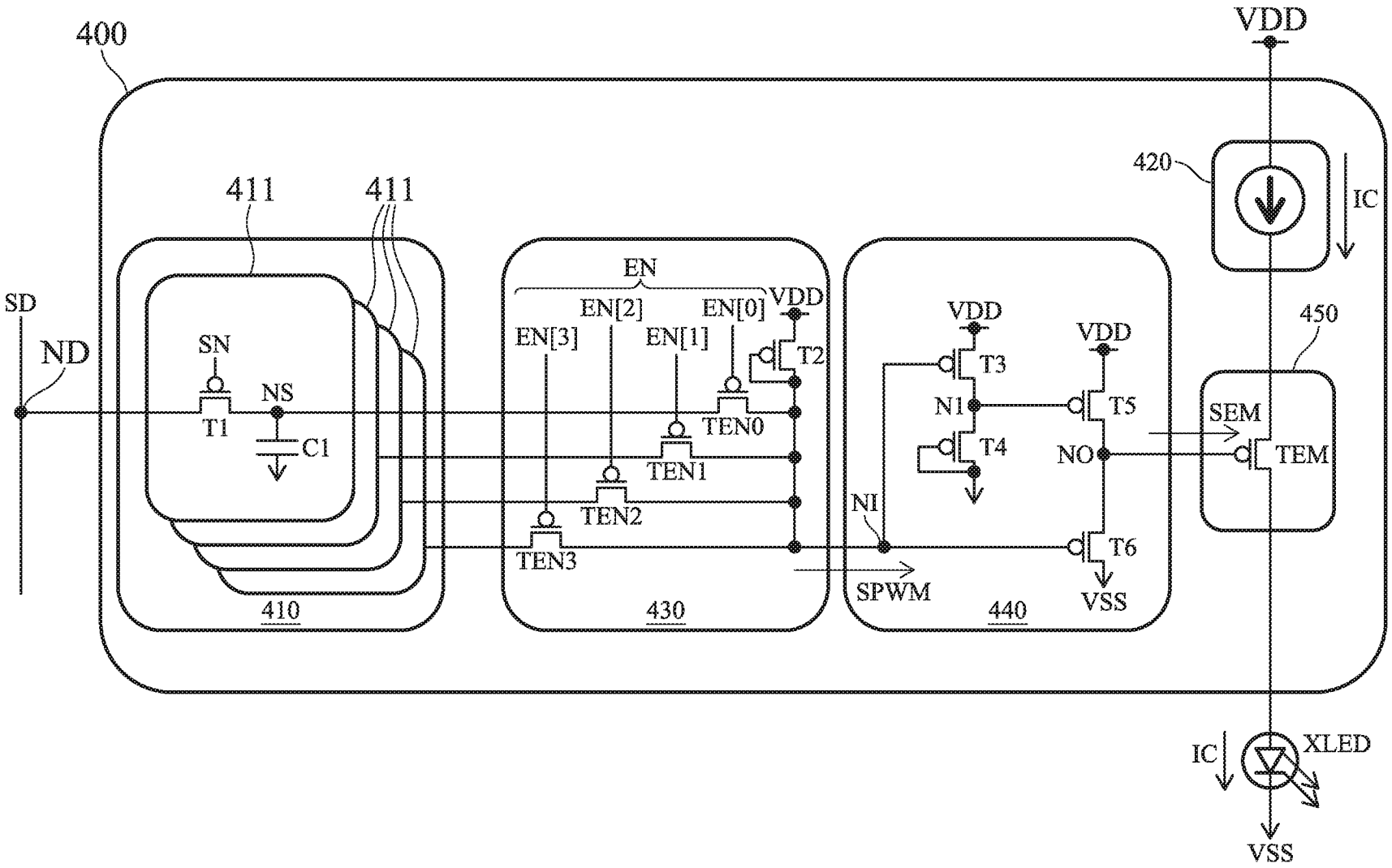
FIG. 4 is a schematic diagram of the driving circuit in accordance with an embodiment of the disclosure.

FIG. 4 is a schematic diagram of the driving circuit in accordance with an embodiment of the disclosure. According to an embodiment of the disclosure, the driving circuit 400 corresponds to the driving circuit 200 in FIG. 2, and the driving circuit 400 is implemented by only P-type transistors.

As shown in FIG. 4, the driving circuit 400 includes a data memory circuit 410, a current source 420, and a PWM control circuit 430, a buffer circuit 440, and a second switch 450. The data memory circuit 410 includes a plurality of data memory units 411. According to an embodiment of the disclosure, the data signal SD is illustrated as 4-bit herein, and the enable signal EN includes a first enable signal EN[0], a second enable signal EN[1], a third enable signal EN[2], and a fourth enable signal EN[3], but not intended to be limited thereto. The data memory circuit 410 includes four data memory units 411 for the simplicity of explanation, but not intended to be limited thereto.

Each of the data memory units 411 includes a first transistor T1 and a first capacitor C1. The first transistor T1 passes a corresponding bit of the data signal SD from a data node ND to the storage node NS. The first capacitor C1, which is coupled between the storage node NS and the ground level VSS, stores the corresponding bit of the data signal SD.

According to an embodiment of the disclosure, the PWM control circuit 430 includes a plurality of first switches, in which the plurality of the first switches and the second switch 450 are transistors of the same type (i.e., the transistors are all P-type or all N-type). As illustrated herein, the first switches in the PWM control circuit 430 include a first transmission transistor TEN0, a second transmission transistor TEN1, a third transmission transistor TEN2, a fourth transmission transistor TEN3, and a second transistor T2 coupled with the supply voltage VDD. The first transmission transistor TEN0, the second transmission transistor TEN1, the third transmission transistor TEN2, and the fourth transmission transistor TEN3 are controlled by the first enable signal EN[0], the second enable signal EN[1], the third enable signal EN[2], and the fourth enable signal EN[3] respectively to pass corresponding bits of the data signal SD to generate the PWM control signal SPWM toward the input node NI. It should be noted that the type of the first switch is not limited to transistor, any electronic component with a switching function can be used as the first switch in the disclosure.

Figure 5:
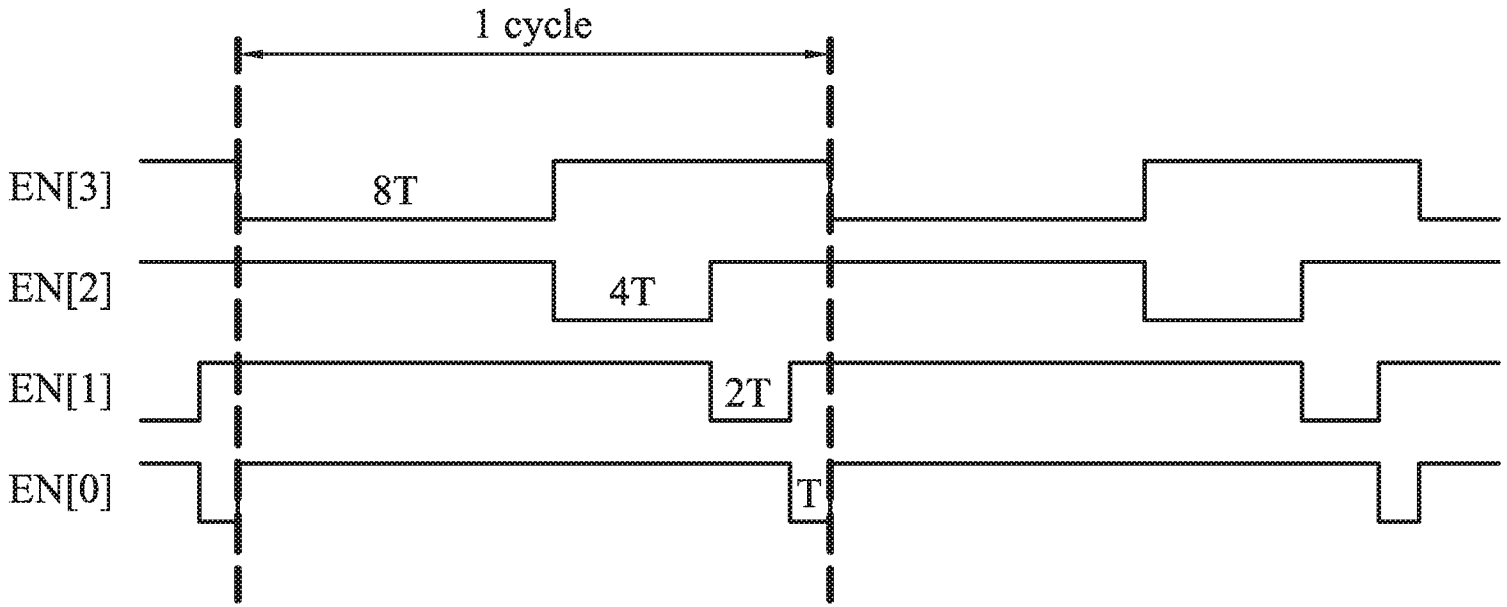
FIG. 5 illustrates waveforms of the enable signal in FIG. 4 in accordance with an embodiment of the disclosure.

FIG. 5 illustrates waveforms of the enable signal in FIG. 4 in accordance with an embodiment of the disclosure. Since the first transmission transistor TEN0, the second transmission transistor TEN1, the third transmission transistor TEN2, and the fourth transmission transistor TEN3 are P-type transistors, the first transmission transistor TEN0, the second transmission transistor TEN1, the third transmission transistor TEN2, and the fourth transmission transistor TEN3 respectively pass a corresponding bit of the data signal SD when the corresponding enable signal EN is at a low voltage level (such as the ground level VSS).

As shown in FIG. 5, the length of each enable signal EN is different. For example, during one duty cycle, the first enable signal EN[0] is activated in 1 sub-duty cycle T (i.e., in low voltage level), the second enable signal EN[1] is activated in 2 sub-duty cycles T, the third enable signal EN[2] is activated in 4 sub-duty cycles T and the fourth enable signal EN[3] is activated in 8 sub-duty cycles T, and the sum of these sub-duty cycles T may equal to 1 duty cycle, but the disclosure is not limited thereto. In some embodiments, the total length of the enable signals EN is different from 1 duty cycle. In some embodiments, the ratio between two neighboring enable signals (such as EN[3] and EN[2]) is not 2. Thus, each bit of the data signal SD is weighted by the corresponding enable signal EN to generate the PWM control signal SPWM at the input node NI. It should be noted that for P-type transistors, signals at a low voltage level (the absolute values of the signals are smaller than absolute value of the threshold voltage of the transistors) can turn on (activate) the transistors, and signals at a high voltage level (the absolute values of the signals are greater than absolute value of the threshold voltage of the transistors) can turn off the transistors, but for N-type transistors, signals at a low voltage level can turn off the transistors, and signals at a high voltage level can turn on the transistors.

Referring to FIG. 4, the buffer circuit 440 includes a third transistor T3, a fourth transistor T4, a fifth transistor T5, and a sixth transistor T6. The third transistor T3 includes a control terminal, a first terminal, and a second terminal, in which the control terminal receives the PWM control signal SPWM, the first terminal is coupled to the supply voltage VDD, and the second terminal is coupled to a first node N1.

The fourth transistor T4 includes a control terminal, a first terminal, and a second terminal, in which the control terminal is coupled to the ground level VSS, the first terminal is coupled to the first node N1, and the second terminal is coupled to the ground level VSS.

The fifth transistor T5 includes a control terminal, a first terminal, and a second terminal, wherein the control terminal is coupled to the first node N1, the first terminal is coupled to the supply voltage VDD, and the second terminal is coupled to an output node NO.

The sixth transistor T6 includes a control terminal, a first terminal, and a second terminal, wherein the control terminal receives the PWM control signal SPWM, the first terminal is coupled to the output node NO, and the second terminal is coupled to the ground level VSS.

According to an embodiment of the disclosure, when the PWM control signal SPWM turns off the third transistor T3, the fourth transistor T4 pulls down the voltage level at the first node N1, the fifth transistor T5 is turned on in response to the low voltage level at the first node N1, and the sixth transistor T6 is turned off in response to the PWM control signal SPWM with a high voltage level. Therefore, the PWM signal SEM at the output node NO is at a high voltage level and the emission transistor TEM is off, then there is no driving current IC flowing through the light emitting unit XLED to the ground level VSS.

According to an embodiment of the disclosure, when the PWM control signal SPWM turns on the third transistor T3 to pull up the voltage level at the first node N1, the fifth transistor T5 is turned off in response to the high voltage level at the first node N1, and the sixth transistor T6 is turned on in response to the PWM control signal SPWM with a low voltage level. Therefore, the PWM signal SEM at the output node NO is at a low voltage level and the emission transistor TEM is on, then the driving current IC flowing through the light emitting unit XLED, and the light emitting unit XLED starts to emit light.

In other words, the third transistor T3 and the fourth transistor T4 are configured as an inverter, and the fifth transistor T5 and the sixth transistor T6 are configured as another inverter. Therefore, when the PWM control signal SPWM is at a high voltage level (such as the supply voltage VDD), the PWM signal SEM is at a high voltage level to turn off the emission transistor TEM, and the light emitting unit XLED doesn't emit light. When the PWM control signal SPWM is at a low voltage level (such as the ground level VSS), the PWM signal SEM is at a low voltage level to turn on the emission transistor TEM, and the light emitting unit XLED starts to emit light.

Referring to FIG. 4, the PWM control circuit 430 further includes a second transistor T2. As shown in FIG. 4, the second transistor T2 pulls up the PWM control signal SPWM to a high voltage level (such as the supply voltage VDD). When all of the first transmission transistor TEN0, the second transmission transistor TEN1, the third transmission transistor TEN2, and the fourth transmission transistor TEN3 are off, the second transistor T2 is configured to provide a voltage to the input node NI. Since the emission transistor TEM is P-type transistor, it is reasonable for the second transistor T2 to provide high voltage level at the input node NI to turn off the emission transistor TEM.

Figure 6:
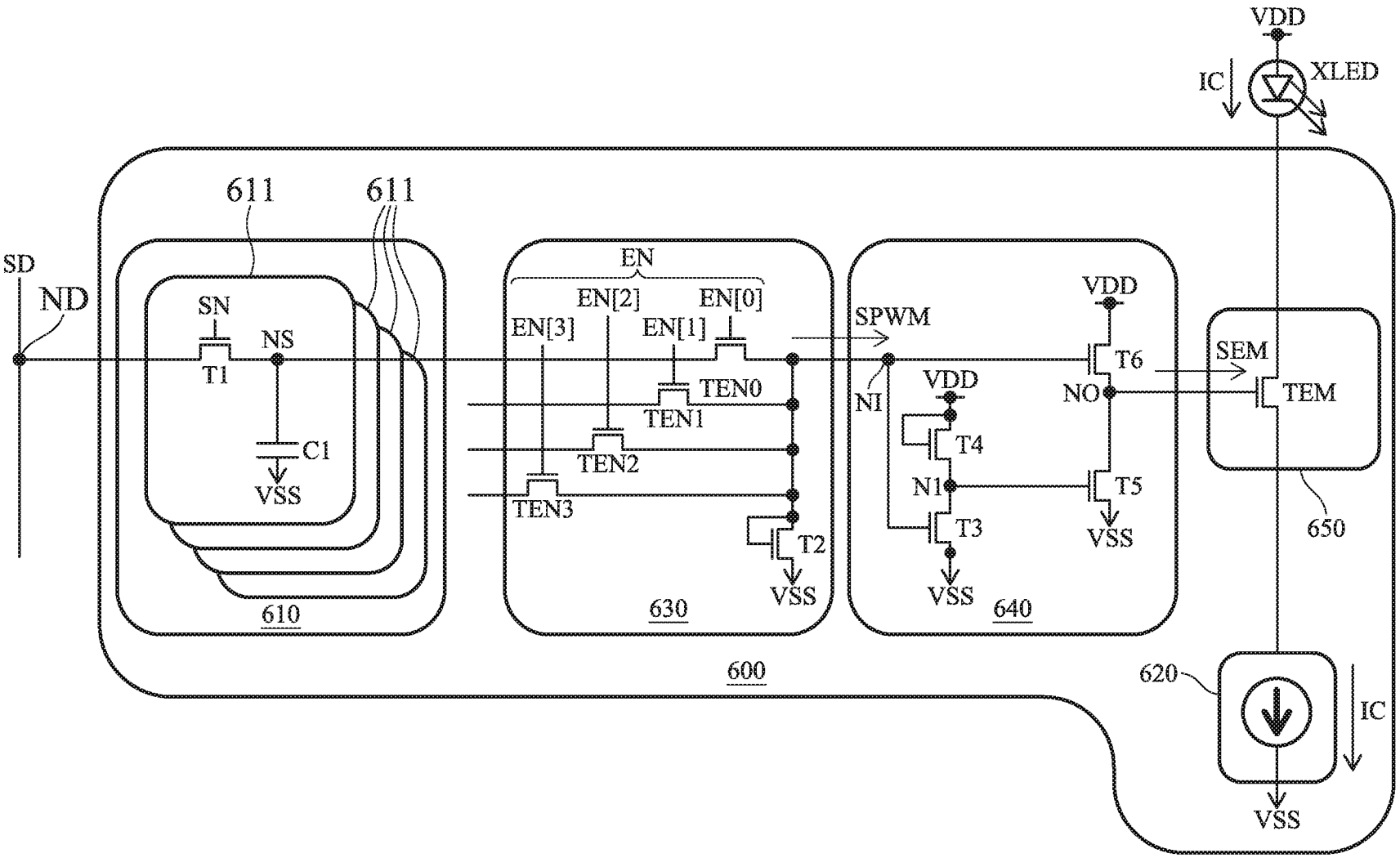
FIG. 6 is a schematic diagram of the driving circuit in accordance with an embodiment of the disclosure.

FIG. 6 is a schematic diagram of the driving circuit in accordance with an embodiment of the disclosure. According to an embodiment of the disclosure, the driving circuit 600 corresponds to the driving circuit 300 in FIG. 3. According to an embodiment of the disclosure, the driving circuit 600 is implemented by only N-type transistors.

As shown in FIG. 6, the driving circuit 600 includes a data memory circuit 610, a current source 620, and a PWM control circuit 630, a buffer circuit 640, and a second switch 650. Compared the driving circuit 600 with the driving circuit 400 in FIG. 4, all the P-type transistors in FIG. 4 are replaced with N-type transistors and some proper modifications. The operations of the driving circuit 600 are similar to those of the driving circuit 400 in FIG. 4, which will not be repeated herein.

Figure 7:
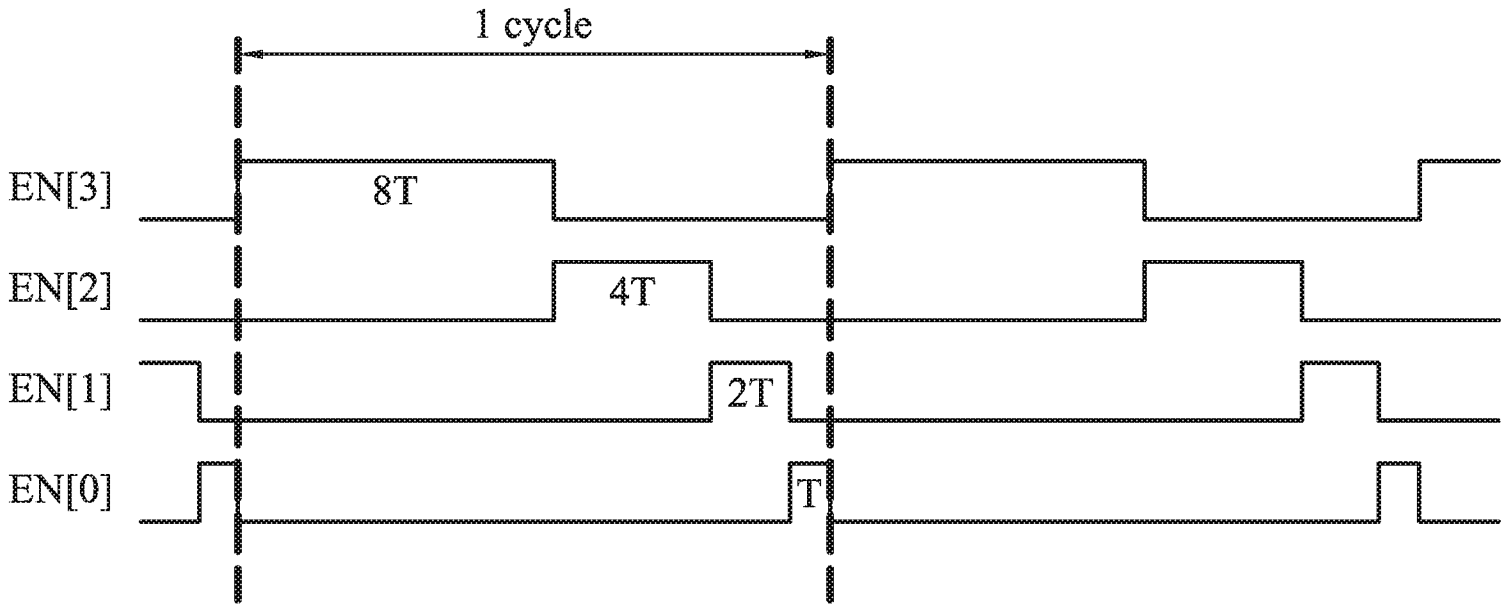
FIG. 7 illustrates waveforms of the enable signal in FIG. 6 in accordance with an embodiment of the disclosure.

FIG. 7 illustrates waveforms of the enable signal in FIG. 6 in accordance with an embodiment of the disclosure. Since the first transmission transistor TEN0, the second transmission transistor TEN1, the third transmission transistor TEN2, and the fourth transmission transistor TEN3 in FIG. 6 are N-type transistors, the first transmission transistor TEN0, the second transmission transistor TEN1, the third transmission transistor TEN2, and the fourth transmission transistor TEN3 passes a corresponding bit of the data signal SD by a first enable signal EN[0], a second enable signal EN[1], a third enable signal EN[2], and a fourth enable signal EN[3] when the enable signals are respectively at a high voltage level.

Figure 8:
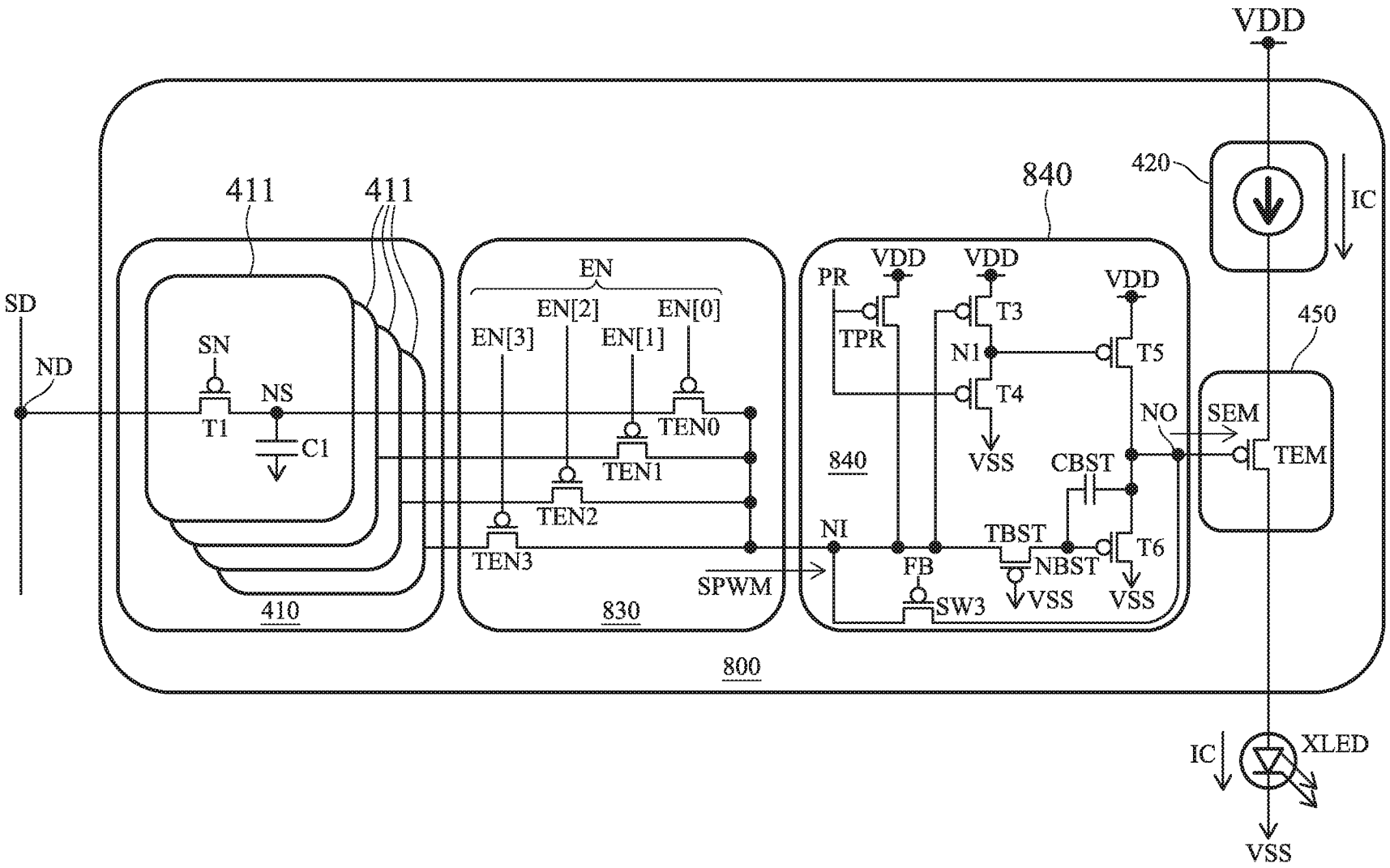
FIG. 8 is a schematic diagram of the driving circuit in accordance with another embodiment of the disclosure.

FIG. 8 is a schematic diagram of the driving circuit in accordance with another embodiment of the disclosure. According to an embodiment of the disclosure, the driving circuit 800 corresponds to the driving circuit 200 in FIG. 2. According to an embodiment of the disclosure, the driving circuit 800 is implemented by only P-type transistors.

As shown in FIG. 8, the driving circuit 800 includes a data memory circuit 410, a current source 420, and a PWM control circuit 830, a buffer circuit 840, and a second switch 450. The data memory circuit 410, the current source 420 and a second switch 450 in FIG. 8 are similar to those in FIG. 4, which will not be repeated herein. Compared the PWM control circuit 830 with the PWM control circuit 430 in FIG. 4, the second transistor T2 of the PWM control circuit 430 in FIG. 4 is omitted for the PWM control circuit 830.

The buffer circuit 840 includes a preset transistor TPR, a third transistor T3, a fourth transistor T4, a fifth transistor T5, a third switch SW3, a bootstrap transistor TBST, a bootstrap capacitor CBST, and a sixth transistor T6.

The preset transistor TPR includes a control terminal, a first terminal, and a second terminal, in which the control terminal receives a preset signal PR, the first terminal is coupled to a supply voltage VDD, and the second terminal is coupled to the input node NI.

The third transistor T3 includes a control terminal, a first terminal, and a second terminal, in which the control terminal receives the PWM control signal SPWM, the first terminal is coupled to the supply voltage VDD, and the second terminal is coupled to a first node N1.

The fourth transistor T4 includes a control terminal, a first terminal, and a second terminal, in which the control terminal receives the preset signal PR, the first terminal is coupled to the first node N1, and the second terminal is coupled to the ground level VSS.

The fifth transistor T5 includes a control terminal, a first terminal, and a second terminal, wherein the control terminal is coupled to the first node N1, the first terminal is coupled to the supply voltage VDD, and the second terminal is coupled to an output node NO.

The third switch SW3 includes a control terminal, a first terminal, and a second terminal, in which the control terminal receives a feedback signal FB, the first terminal is coupled to the input node NI, and the second terminal is coupled to the output node NO.

The bootstrap transistor TBST includes a control terminal, a first terminal, and a second terminal, wherein the control terminal is coupled to the ground level VSS, the first terminal is coupled to the input node NI, and the second terminal is coupled to a bootstrap node NB ST.

The bootstrap capacitor CBST is coupled between the bootstrap node NBST and the output node NO. The sixth transistor T6 includes a control terminal, a first terminal, and a second terminal, in which the control terminal is coupled to the bootstrap node NBST, the first terminal is coupled to the output node NO, and the second terminal is coupled to the ground level VSS.

Figure 9:
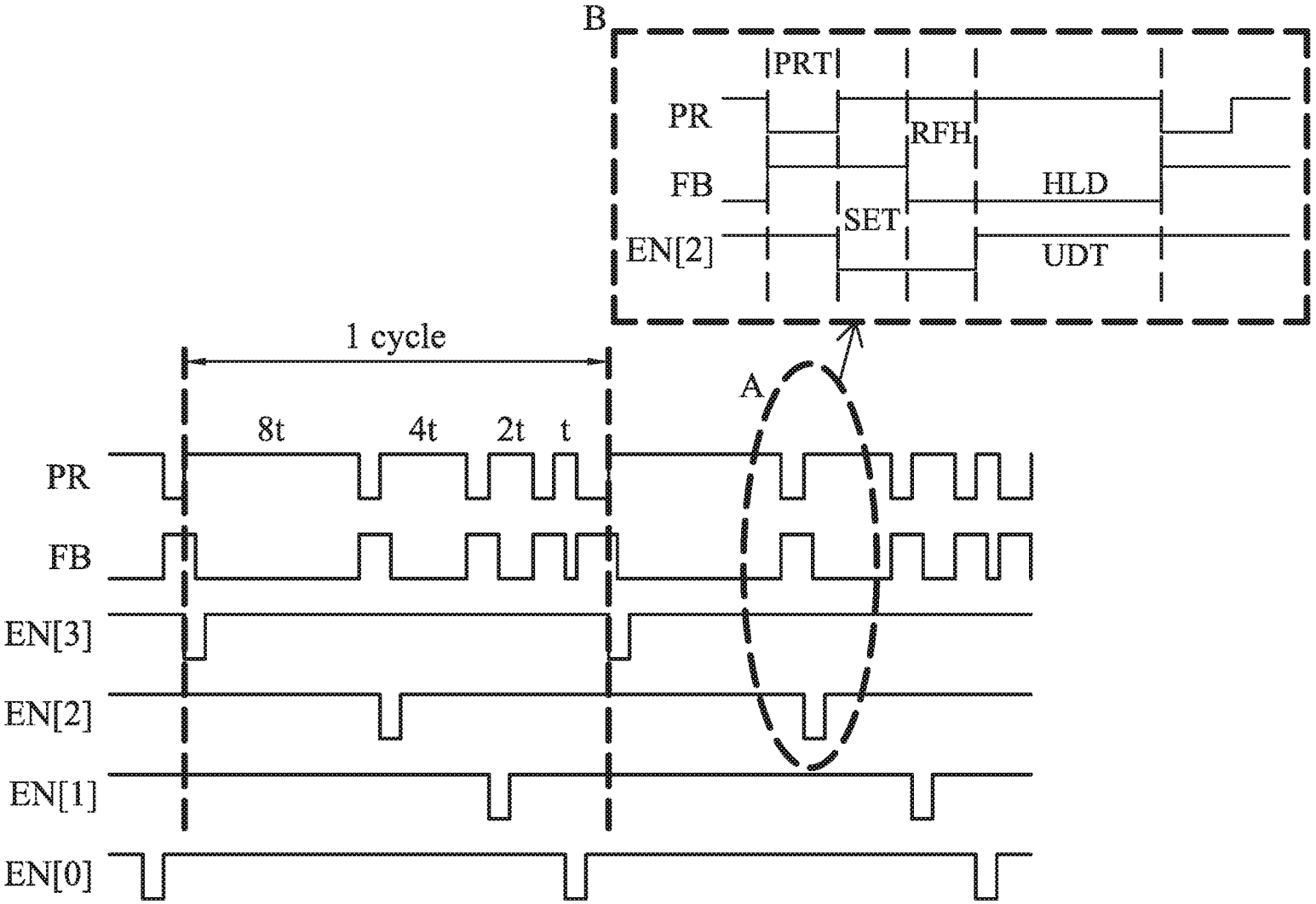
FIG. 9 illustrates a timing diagram of the driving circuit in FIG. 8 in accordance with an embodiment of the disclosure.

FIG. 9 illustrates a timing diagram of the driving circuit in FIG. 8 in accordance with an embodiment of the disclosure. As shown in FIG. 8, when the preset signal PR is at a low voltage level (such as the ground level VSS), the preset transistor TPR passes the supply voltage VDD to the input node NI. When the preset signal PR is at a high voltage level (such as the supply voltage VDD), the driving circuit 800 drives the light emitting unit XLED according to the data signal SD and the enable signals EN. It should be noted that in FIG. 9, the lengths of the high-voltage preset signals PR (the preset signals PR is at a high voltage level) corresponding to different enable signals EN are different. For example, the length of a high-voltage preset signal PR corresponding the fourth enable signal EN[3] is twice the length of a high-voltage preset signals PR corresponding to the third enable signal EN[2], and the length of a high-voltage preset signal PR corresponding the third enable signal EN[2] is twice the length of a high-voltage preset signals PR corresponding to the second enable signal EN[1], and so on. But the disclosure is not limited thereto. Meanwhile, the lengths of enable signals EN (the enable signal is at a low voltage level) are substantially the same, but the disclosure is not limited thereto.

As shown in FIG. 9, the area A has been enlarged to be the area B. According to an embodiment of the disclosure, when the driving circuit 800 operates in a preset state PRT (the preset signal PR is at a low voltage level), the feedback signal FB and a corresponding enable signal EN (i.e., the third enable signal EN[2] as illustrated in FIG. 9) are at a high voltage level.

Referring to FIG. 8, the input node NI is preset to be at a high voltage level (such as the supply voltage VDD) through the preset transistor TPR. The preset signal PR in the ground level VSS also turns on the fourth transistor T4 to pull the first node N1 down to a low voltage level (such as the ground level VSS) to turn on the fifth transistor T5 for passing the supply voltage VDD to the output node NO. Therefore, the emission transistor TEM is off due to the output node NO at a high voltage level.

According to an embodiment of the disclosure, when the driving circuit 800 operates in a data-setup state SET, the feedback signal FB and the preset signal PR are at a high voltage level and a corresponding enable signal EN (i.e., the third enable signal EN[2] as illustrated in FIG. 9) is at a low voltage level to turn on the corresponding transistors TEN0~TEN3 in the PWM control circuit 830, then the corresponding bit of the data signal SD stored in the data memory circuit 410 is transmitted through the PWM control circuit 830 and setup at the input node NI.

When the corresponding bit of the data signal SD transmitted to the input node NI is at a low voltage level, the corresponding bit of the data signal SD in the low voltage level passes through the bootstrap transistor TBST to turn on the sixth transistor T6 such that the output node NO is pulled down to a low voltage level (such as the ground level VSS).

Referring to FIG. 9, according to an embodiment of the disclosure, when the driving circuit 800 operates in a data-refresh state RFH, the corresponding enable signal EN (i.e., the third enable signal EN[2] as illustrated in FIG. 9) and the feedback signal FB are at a low voltage level (such as the ground level VSS) and the preset signal PR is at a high voltage level (such as the supply voltage VDD). If the data stored in the first capacitor C1 is at a low voltage level, the first capacitor C1 is refreshed by the ground level VSS through sixth transistor T6, the third switch SW3, and the PWM control circuit 830.

According to an embodiment of the disclosure, since the first capacitor C1 of the data memory unit 411 can be refreshed by the buffer circuit 840, it is not necessary for the data driver to refresh the data signal SD once again. According to an embodiment of the disclosure, the data signal SD is generated by the data driver, which will be further discussed in the following paragraphs.

According to an embodiment of the disclosure, when the driving circuit 800 operates in a hold-and-update state HLD&UDT, the preset signal PR and the corresponding enable signal EN (i.e., the third enable signal EN[2] as illustrated in FIG. 9) are at a high voltage level (such as the supply voltage VDD) and the feedback signal FB is at a low voltage level (such as the ground level VSS). The data memory circuit 410 can receive another data signal SD and, meanwhile, the buffer circuit 840 still holds the state of the PWM signal SEM to drive the light emitting unit XLED.

Figure 10:
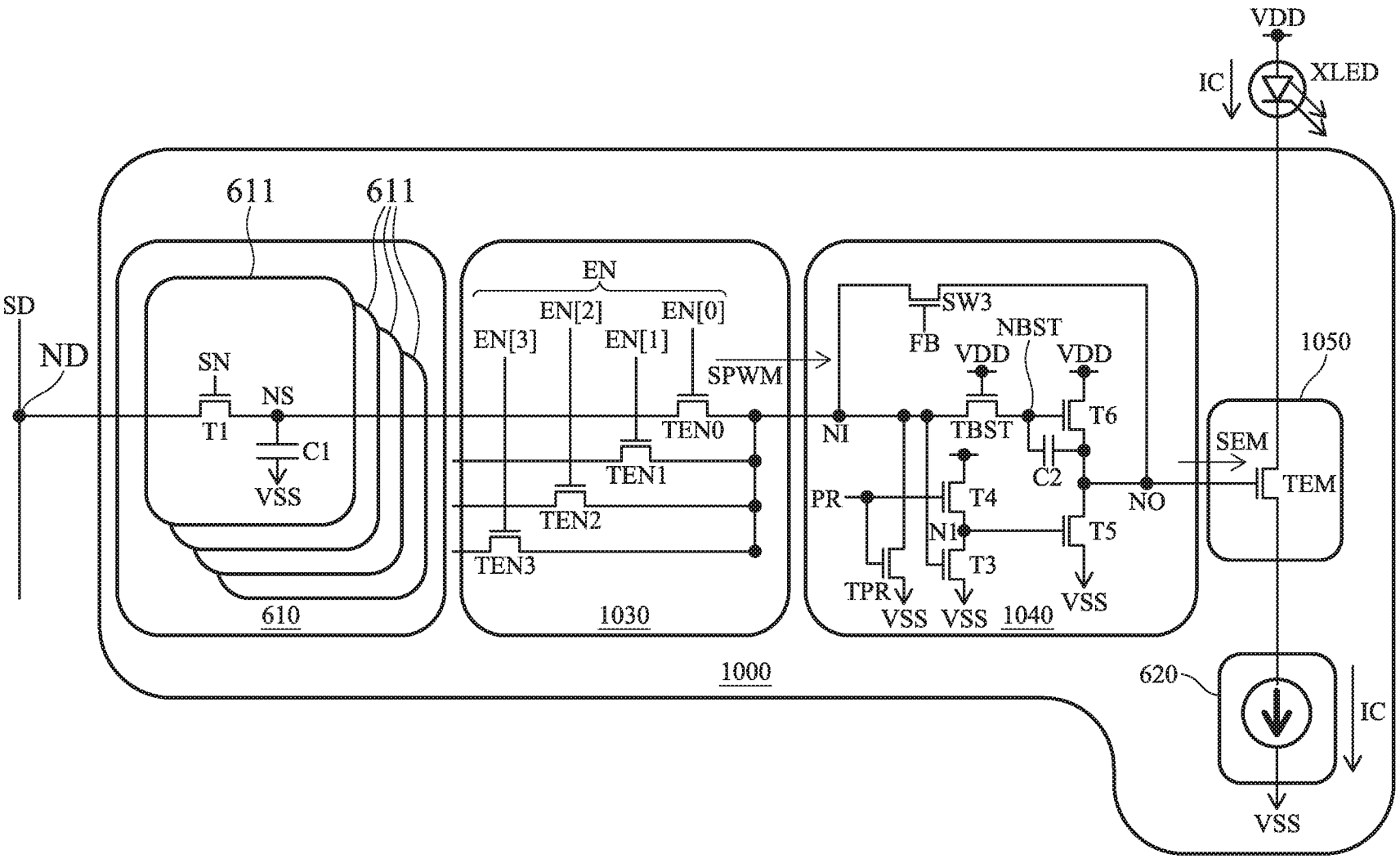
FIG. 10 is a schematic diagram of the driving circuit in accordance with another embodiment of the disclosure.

FIG. 10 is a schematic diagram of the driving circuit in accordance with another embodiment of the disclosure. According to an embodiment of the disclosure, the driving circuit 1000 corresponds to the driving circuit 300 in FIG. 3. According to an embodiment of the disclosure, the driving circuit 1000 is implemented by only N-type transistors.

As shown in FIG. 10, the driving circuit 1000 includes a data memory circuit 610, a current source 620, and a PWM control circuit 1030, a buffer circuit 1040, and a second switch 650. Compared the driving circuit 1000 with the driving circuit 800 in FIG. 8, all the P-type transistors in FIG. 8 are replaced with N-type transistors and some proper modifications. The operations of the driving circuit 1000 are similar to those of the driving circuit 800 in FIG. 8, which will not be repeated herein.

Figure 11:
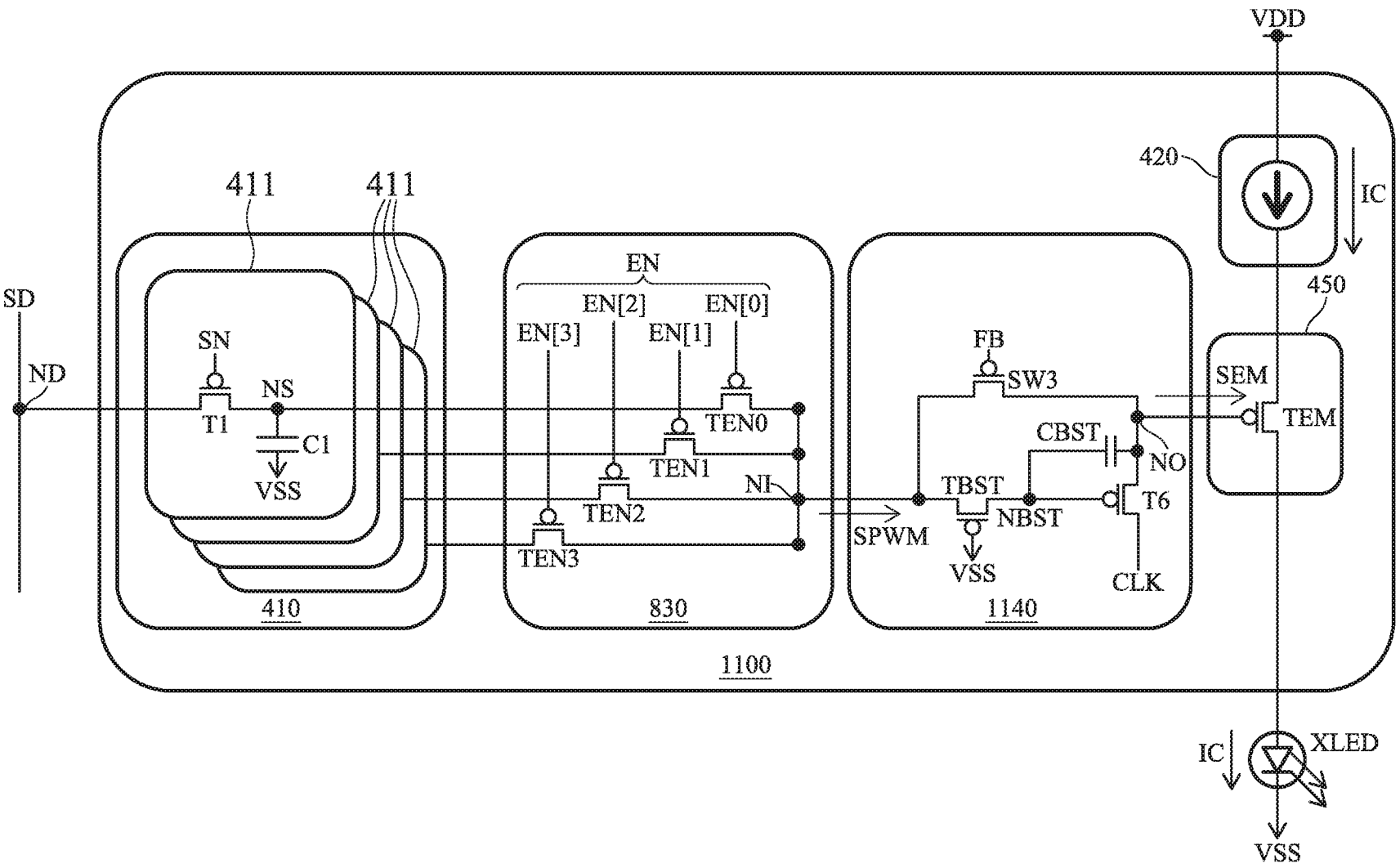
FIG. 11 is a schematic diagram of the driving circuit in accordance with yet another embodiment of the disclosure.

FIG. 11 is a schematic diagram of the driving circuit in accordance with yet another embodiment of the disclosure. According to an embodiment of the disclosure, the driving circuit 1100 corresponds to the driving circuit 200 in FIG. 2. According to an embodiment of the disclosure, the driving circuit 1100 is implemented by only P-type transistors.

As shown in FIG. 11, the driving circuit 1100 includes a data memory circuit 410, a current source 420, and a PWM control circuit 830, a buffer circuit 1140, and a second switch 450. The data memory circuit 410, the current source 420 and a second switch 450 in FIG. 11 are similar to those in FIG. 4, which will not be repeated herein. The PWM control circuit 830 in FIG. 11 is similar to that in FIG. 8, which is not repeated herein.

The buffer circuit 1140 includes a third switch SW3, a bootstrap transistor TBST, a bootstrap capacitor CBST, and a sixth transistor T6. The third switch SW3 includes a control terminal, a first terminal, and a second terminal, wherein the control terminal receives a feedback signal FB, the first terminal is coupled to the input node NI, and the second terminal is coupled to the output node NO.

The bootstrap transistor TBST includes a control terminal, a first terminal, and a second terminal, wherein the control terminal is coupled to the ground level VSS, the first terminal is coupled to the input node NI, and the second terminal is coupled to a bootstrap node NB ST.

The bootstrap capacitor CBST is coupled between the bootstrap node NBST and the output node NO. The sixth transistor T6 includes a control terminal, a first terminal, and a second terminal, wherein the control terminal is coupled to the bootstrap node NBST, the first terminal is coupled to the output node NO, and the second terminal receives a clock signal CLK.

Figure 12:
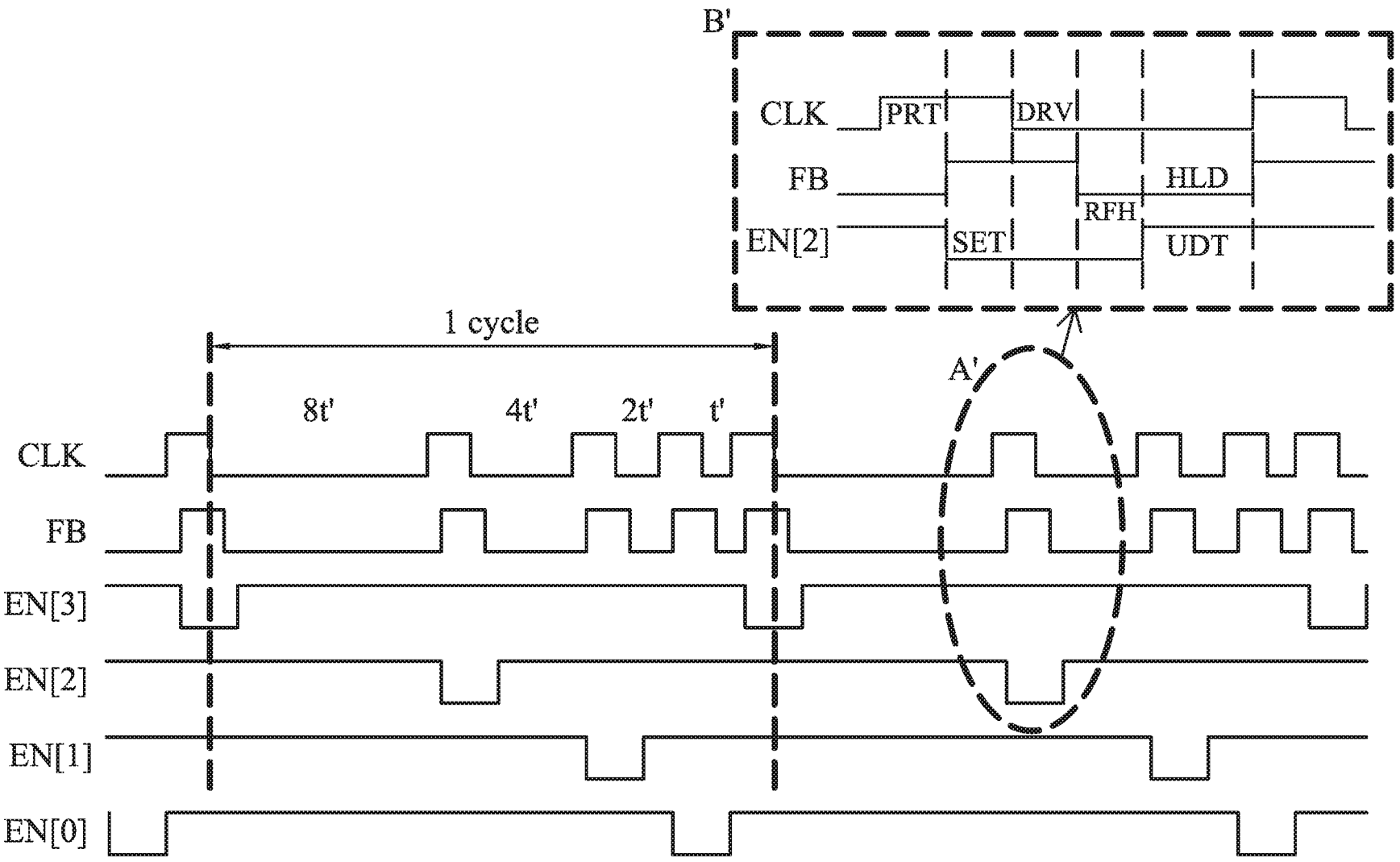
FIG. 12 illustrates a timing diagram of the driving circuit in FIG. 11 in accordance with an embodiment of the disclosure.

FIG. 12 illustrates a timing diagram of the driving circuit in FIG. 11 in accordance with an embodiment of the disclosure. As shown in FIG. 12, the area A' has been enlarged to be the area B'.

According to an embodiment of the disclosure, when the driving circuit 1100 operates in a preset state PRT, the clock signal CLK and a corresponding enable signal EN (i.e., the third enable signal EN[2] as illustrated in FIG. 12) are at a high voltage level (such as the supply voltage VDD) and the feedback signal FB is at a low voltage level (such as the ground level VS S), so that the input node NI and the output node NO are preset to a high voltage level and the emission transistor TEM is off.

According to an embodiment of the disclosure, when the driving circuit 1100 operates in a data-setup state SET, the clock signal CLK and the feedback signal FB are at a high voltage level (such as the supply voltage VDD) and the corresponding enable signal EN (i.e., the third enable signal EN[2] as illustrated in FIG. 12) is at a low voltage level (such as the ground level VSS). A corresponding bit of the data signal SD stored in the data memory circuit 410 is transmitted to the input node NI through the PWM control circuit 830.

It should be noted that in FIG. 12, the lengths of the low-voltage clock signal CLK (the clock signal CLK is at a low voltage level) corresponding to different enable signals EN are different. For example, the length of a low-voltage clock signal CLK corresponding the fourth enable signal EN[3] is twice the length of a low-voltage clock signal CLK corresponding to the third enable signal EN[2], and the length of a low-voltage clock signal CLK corresponding the third enable signal EN[2] is twice the length of a low-voltage clock signal CLK corresponding to the second enable signal EN[1], and so on. But the disclosure is not limited thereto. Meanwhile, the lengths of enable signals EN (the enable signal is at a low voltage level) are substantially the same, but the disclosure is not limited thereto.

According to yet an embodiment of the disclosure, when the driving circuit 1100 operates in a drive state DRV, the clock signal CLK and the corresponding enable signal EN (i.e., the third enable signal EN[2] as illustrated in FIG. 12) are at a low voltage level (such as the ground level VSS) and the feedback signal FB is in the supply voltage VDD. When the PWM control signal SPWM is at a low voltage level (such as the ground level VSS), the bootstrap transistor TBST passes the PWM control signal SPWM to turn on the sixth transistor T6.

Then, the sixth transistor T6 pulls the output node NO down to a low voltage level to turn on the emission transistor TEM.

According to an embodiment of the disclosure, when the driving circuit 1100 operates in a data-refresh state RFH, the clock signal CLK, the corresponding enable signal EN (i.e., the third enable signal EN[2] as illustrated in FIG. 12), and the feedback signal FB are at a low voltage level (such as the ground level VSS). The data stored in the first capacitor C1 of the corresponding data memory unit 411 is refreshed by the ground level VSS through the sixth transistor T6, the third switch SW3 and the PWM control circuit 830.

According to an embodiment of the disclosure, when the driving circuit 1100 operates in a hold-and-update state HLD&UDT, the clock signal CLK and the feedback signal FB are at a low voltage level (such as the ground level VSS) and the corresponding enable signal EN (i.e., the third enable signal EN[2] as illustrated in FIG. 12) is at a high voltage level (such as the supply voltage VDD). The data memory circuit 410 receives another data signal SD and the buffer circuit 1140 holds the state of the PWM signal SEM to drive the light emitting unit XLED.

Figure 13:
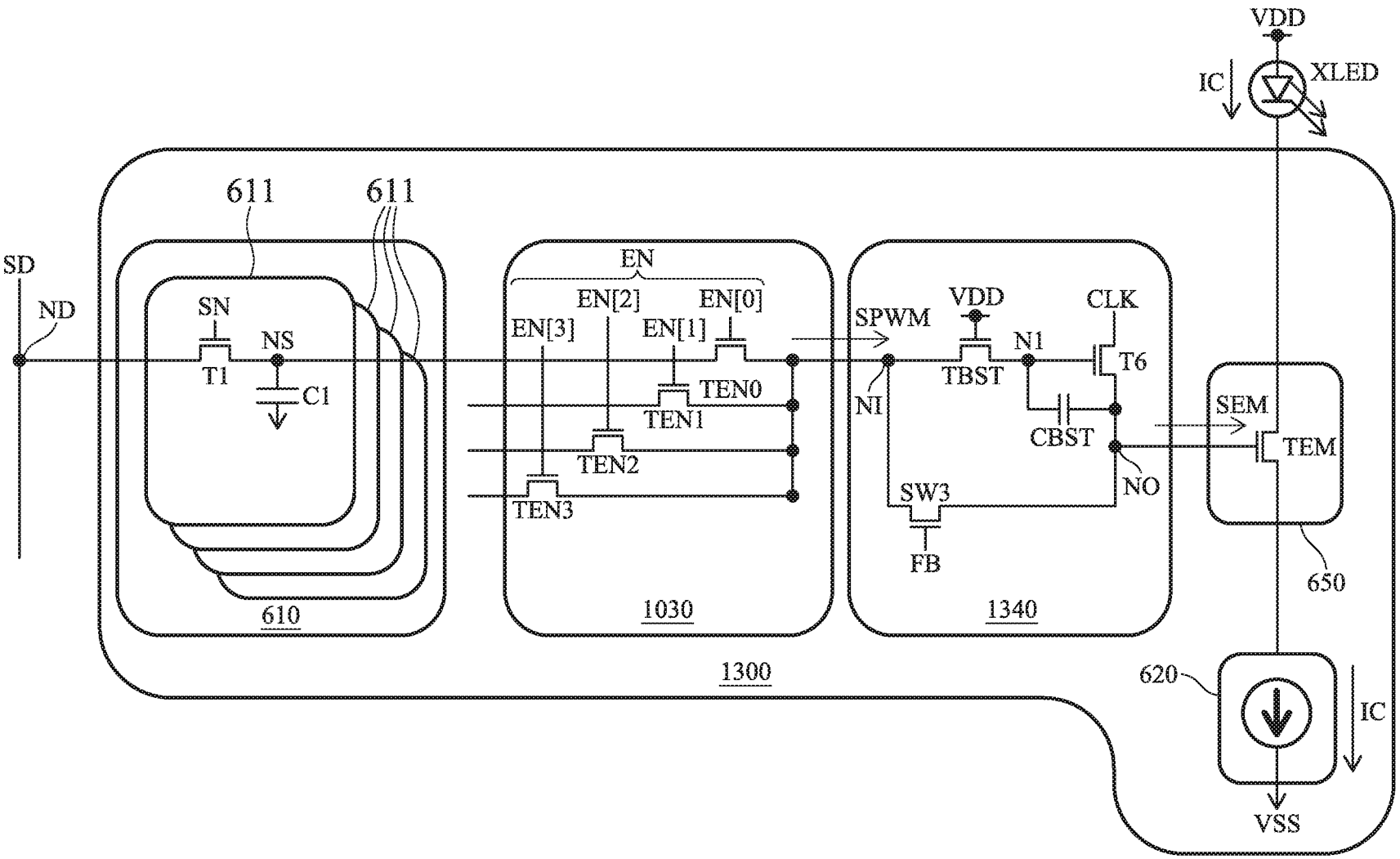
FIG. 13 is a schematic diagram of the driving circuit in accordance with another embodiment of the disclosure.

FIG. 13 is a schematic diagram of the driving circuit in accordance with another embodiment of the disclosure. According to an embodiment of the disclosure, the driving circuit 1300 corresponds to the driving circuit 300 in FIG. 3. According to an embodiment of the disclosure, the driving circuit 1300 is implemented by only N-type transistors.

As shown in FIG. 13, the driving circuit 1300 includes a data memory circuit 610, a current source 620, and a PWM control circuit 1030, a buffer circuit 1340, and a second switch 650. Compared the driving circuit 1300 with the driving circuit 1100 in FIG. 11, all the P-type transistors in FIG. 11 are replaced with N-type transistors and some proper modifications. The operations of the driving circuit 1300 are similar to those of the driving circuit 1100 in FIG. 11, which will not be repeated herein.

Figure 14:
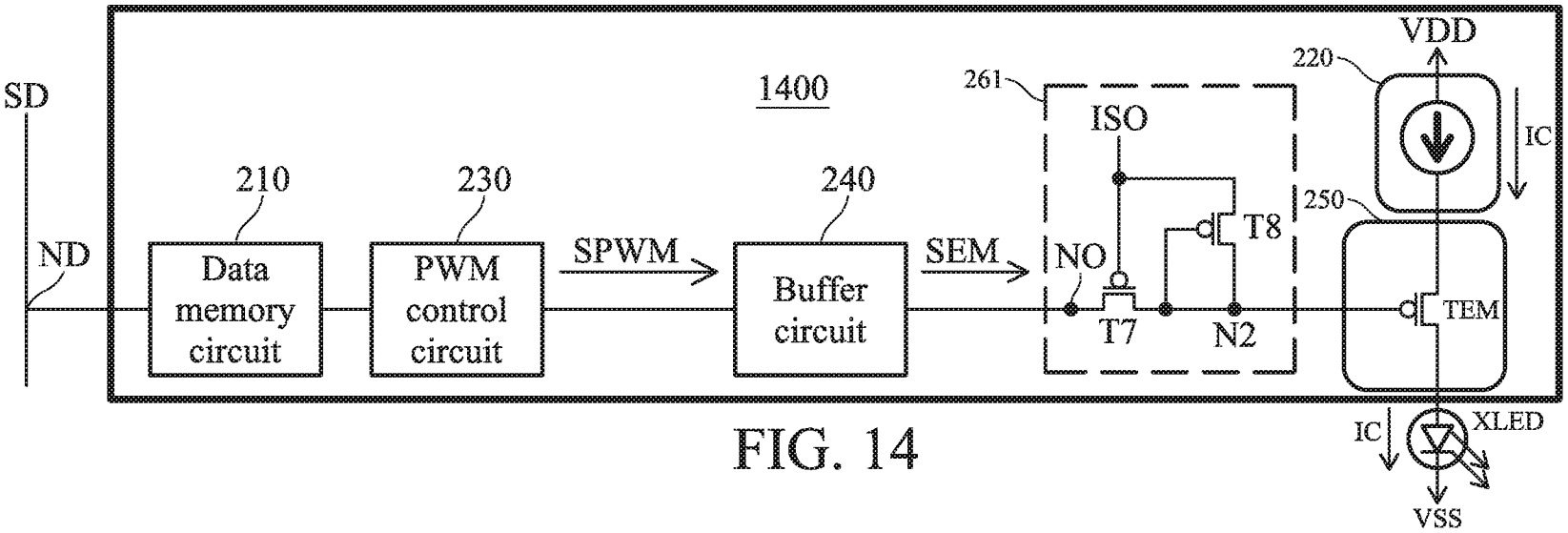
FIG. 14 is a block diagram of a driving circuit in accordance with another embodiment of the disclosure.

FIG. 14 is a block diagram of a driving circuit in accordance with another embodiment of the disclosure. Compared the driving circuit 1400 with the driving circuit 200 in FIG. 2, the driving circuit 1400 further includes an emission control circuit 261. According to an embodiment of the disclosure, the emission control circuit 261 couples the buffer circuit 240 to the second switch 250 according to an emission control signal ISO.

As shown in FIG. 14, the emission control circuit 261 includes a seventh transistor T7 and an eighth transistor T8. The seventh transistor T7 includes a control terminal, a first terminal, and a second terminal, wherein the control terminal receives the emission control signal ISO, the first terminal is coupled to the buffer circuit 240, and the second terminal is coupled to the second node N2. As shown in FIG. 14, the second node N2 is coupled to the gate terminal of the emission transistor TEM.

The eighth transistor T8 includes a control terminal, a first terminal, and a second terminal, wherein the control terminal is coupled to the second node N2, the first terminal receives the emission control signal ISO, and the second terminal is coupled to the second node N2.

According to an embodiment of the disclosure, when the emission control signal ISO is at a high voltage level (such as the supply voltage VDD), the seventh transistor T7 is turned off to choke the PWM signal SEM, and the emission control signal ISO pulls up the second node N2 to a high voltage level (such as the supply voltage VDD) through the eighth transistor T8.

According to an embodiment of the disclosure, when the emission control signal ISO is at a low voltage level (such as the ground level VSS), the seventh transistor T7 is turned on such that the buffer circuit 240 is able to provide the PWM signal SEM to the second switch 250. When the PWM signal SEM is at a high voltage level (such as the supply voltage VDD), the eighth transistor T8 is turned off since the control terminal of the eighth transistor T8 is coupled to the PWM signal SEM. When the PWM signal SEM is at a low voltage level (such as the ground level VSS), the control terminal, the first terminal, and the second terminal of the eighth transistor T8 are also at a low voltage level.

Figure 15:
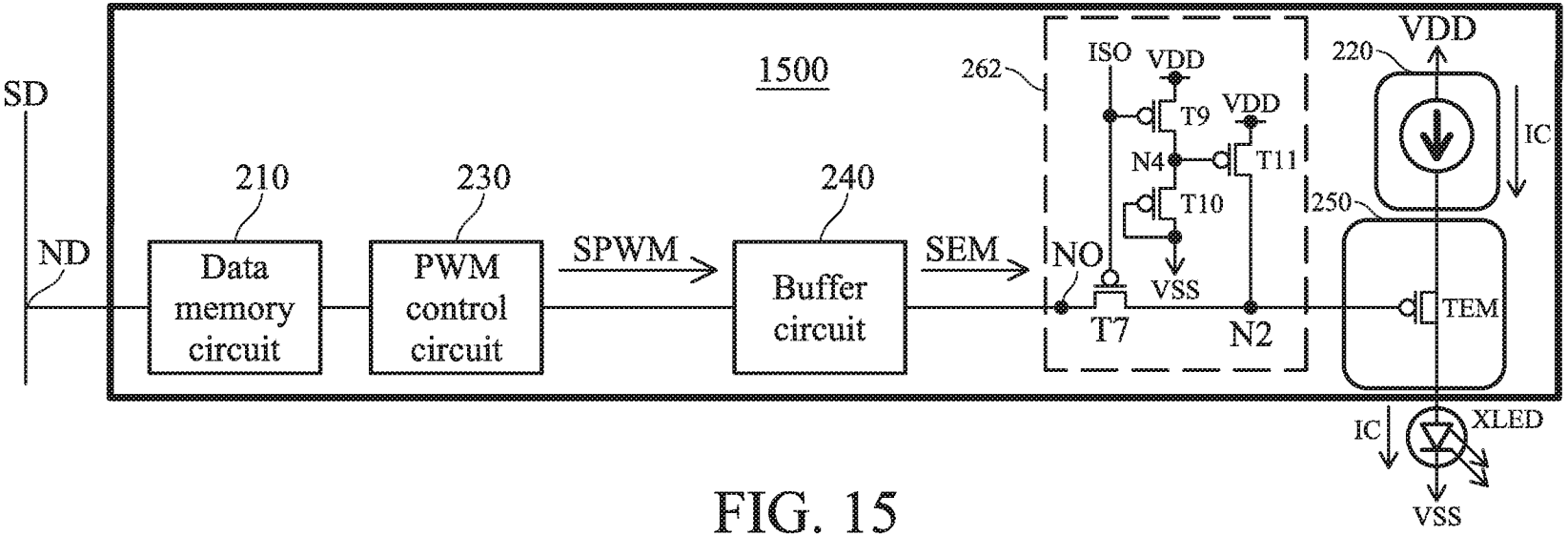
FIG. 15 is a block diagram of a driving circuit in accordance with yet another embodiment of the disclosure.

FIG. 15 is a block diagram of a driving circuit in accordance with yet another embodiment of the disclosure. Compared the driving circuit 1500 with the driving circuit 1400 in FIG. 14, the emission control circuit 261 is replaced with the emission control circuit 262.

The emission control circuit 262 includes a seventh transistor T7, a ninth transistor T9, a tenth transistor T10, and an eleventh transistor T11. The seventh transistor T7 includes a control terminal, a first terminal, and a second terminal, wherein the control terminal receives the emission control signal ISO, the first terminal is coupled to the buffer circuit 240, and the second terminal is coupled to the second node N2.

The ninth transistor T9 includes a control terminal, a first terminal, and a second terminal, wherein the control terminal receives the emission control signal ISO, the first terminal is coupled to the supply voltage VDD, and the second terminal is coupled to the fourth node N4.

The tenth transistor T10 includes a control terminal, a first terminal, and a second terminal, wherein the control terminal is coupled to the ground level VSS, the first terminal is coupled to the fourth node N4, and the second terminal is coupled to the ground level VSS.

The eleventh transistor T11 includes a control terminal, a first terminal, and a second terminal, wherein the control terminal is coupled to the fourth node N4, the first terminal is coupled to the supply voltage VDD, and the second terminal is coupled to the second node N2.

According to an embodiment of the disclosure, when the emission control signal ISO is at a high voltage level (such as the supply voltage VDD), the seventh transistor T7 is turned off. The ninth transistor T9 and the tenth transistor T10 are configured as an inverter to turn on the eleventh transistor T11 such that the eleventh transistor T11 provides the supply voltage VDD to the second node N2 to turn off the emission transistor TEM because the second node N2 is at a high voltage level (such as the supply voltage VDD).

According to an embodiment of the disclosure, when the emission control signal ISO is at a low voltage level (such as the ground level VSS), the seventh transistor T7 is turned on such that the buffer circuit 240 is able to provide the PWM signal SEM to the second switch 250. The ninth transistor T9 and the tenth transistor T10 are configured as an inverter to turn off the eleventh transistor T11.

Figure 16:
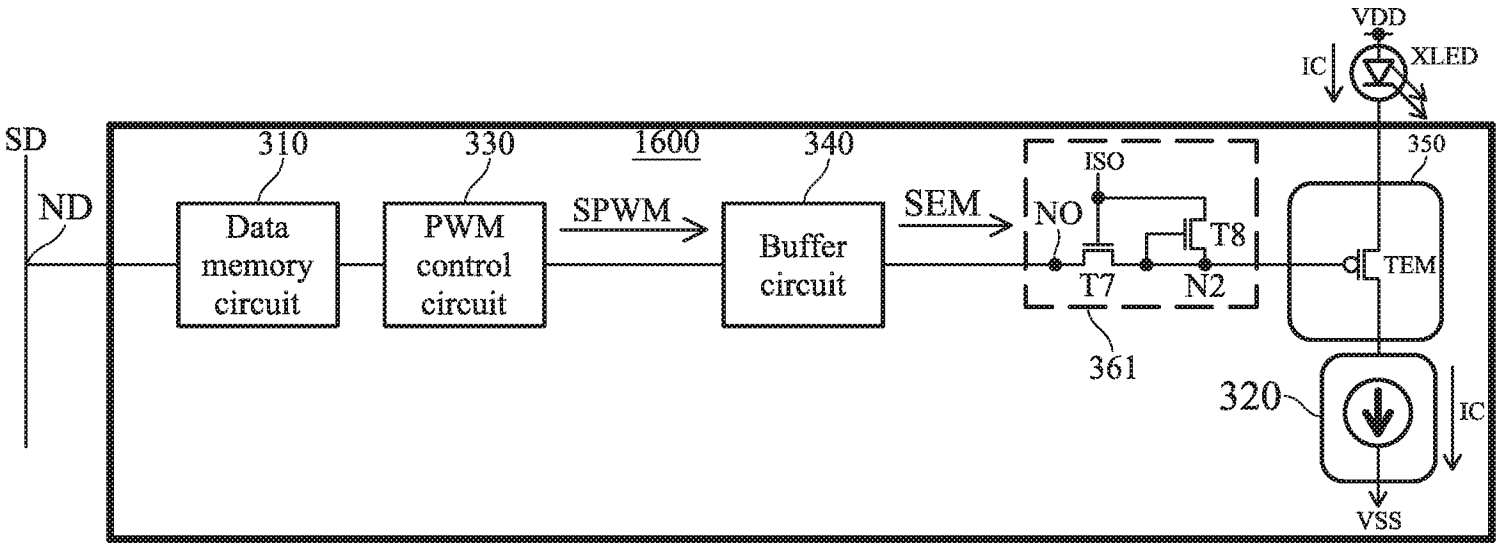
FIG. 16 is a block diagram of a driving circuit in accordance with another embodiment of the disclosure.

FIG. 16 is a block diagram of a driving circuit in accordance with another embodiment of the disclosure. Compared the driving circuit 1600 with the driving circuit 300 in FIG. 3, the driving circuit 1600 further includes an emission control circuit 361. According to an embodiment of the disclosure, the emission control circuit 361 couples the output node NO of the buffer circuit 340 to the second switch 350 according to an emission control signal ISO.

Compared the emission control circuit 361 with the emission control circuit 261 in FIG. 14, all the P-type transistors in FIG. 14 are replaced with N-type transistors and some proper modifications. The operation of the emission control circuit 361 is similar to that of the emission control circuit 261 in FIG. 14, which is not repeated herein.

Figure 17:
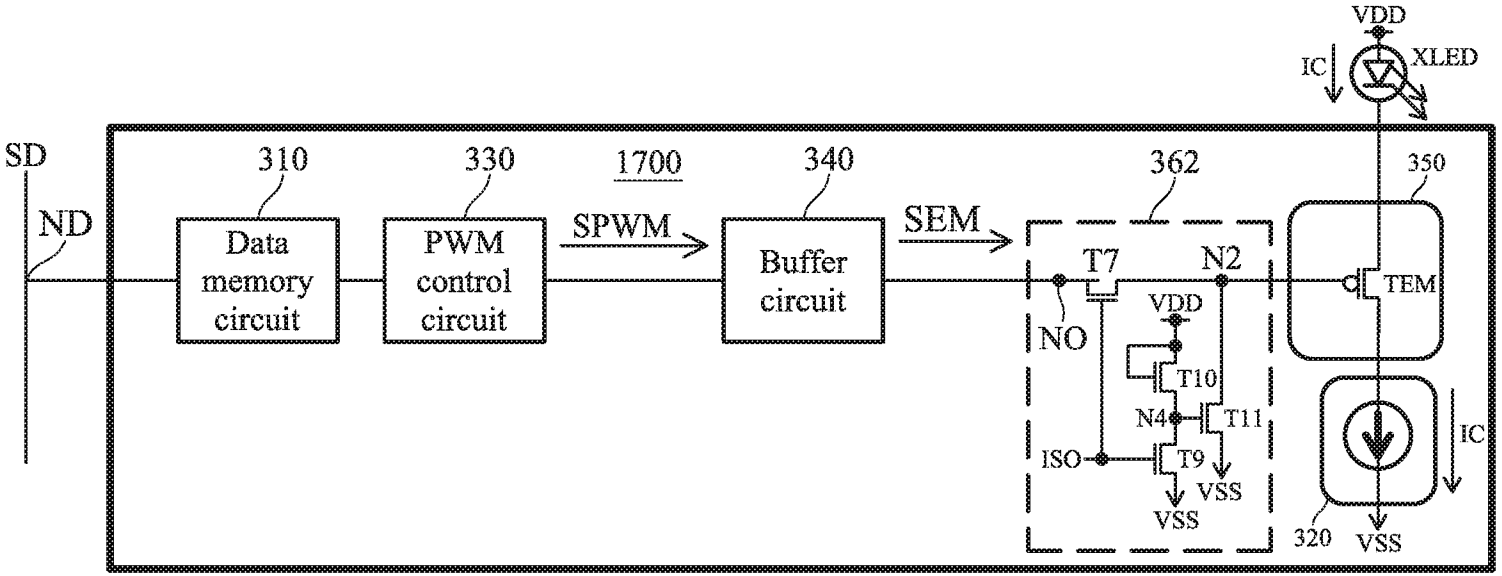
FIG. 17 is a block diagram of a driving circuit in accordance with another embodiment of the disclosure.

FIG. 17 is a block diagram of a driving circuit in accordance with another embodiment of the disclosure. Compared the driving circuit 1700 with the driving circuit 300 in FIG. 3, the driving circuit 1700 further includes an emission control circuit 362. According to an embodiment of the disclosure, the emission control circuit 362 is disposed between the buffer circuit 340 and the second switch 350.

Compared the emission control circuit 362 with the emission control circuit 262 in FIG. 15, all the P-type transistors in FIG. 15 are replaced with N-type transistors and some proper modifications. The operation of the emission control circuit 362 is similar to that of the emission control circuit 262 in FIG. 15, which is not repeated herein.

Figure 18:
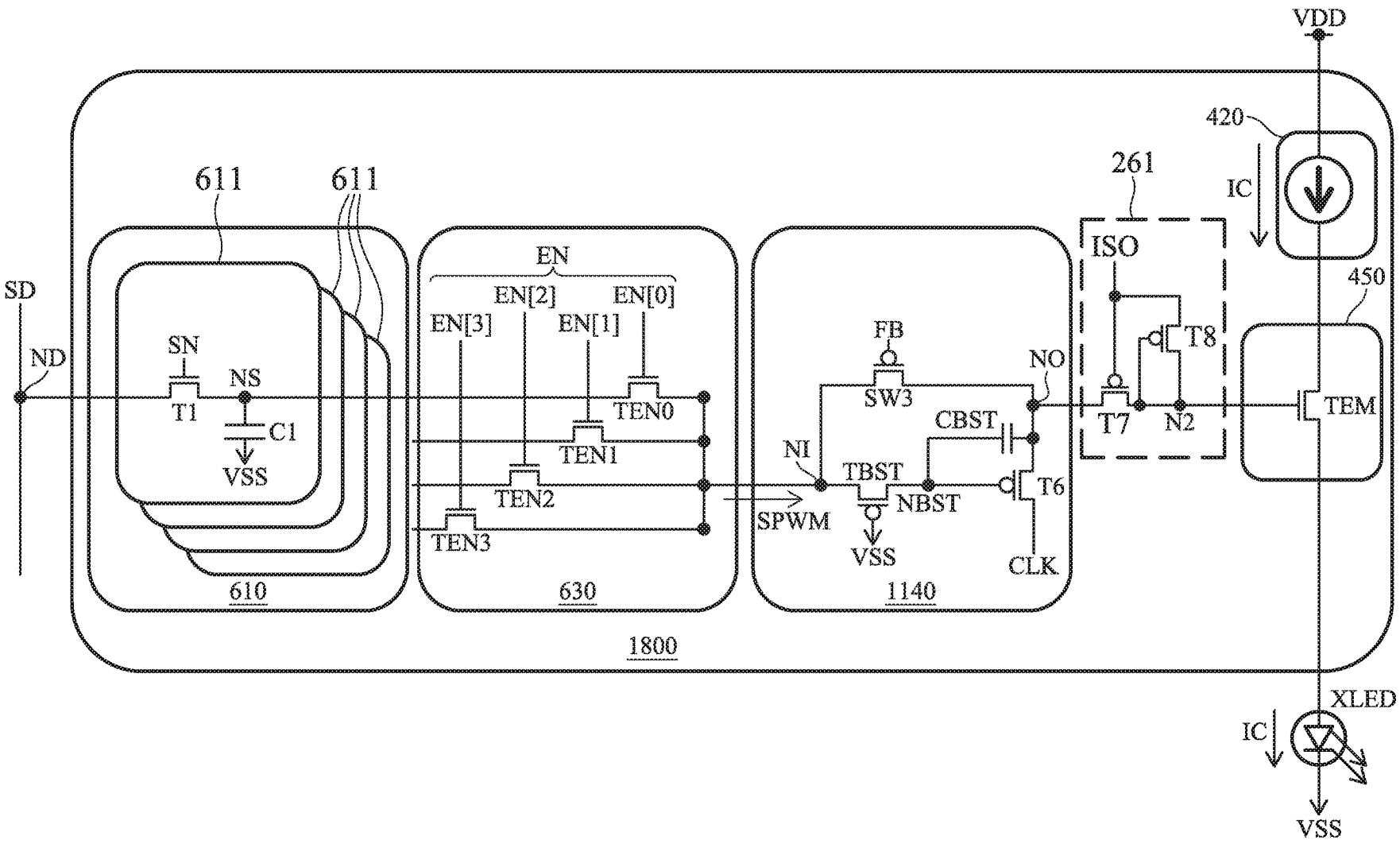
FIG. 18 is a block diagram of a driving circuit in accordance with another embodiment of the disclosure.

FIG. 18 is a block diagram of a driving circuit in accordance with another embodiment of the disclosure. As shown in FIG. 18, the driving circuit 1800 includes a data memory circuit 610, a current source 420, a PWM control circuit 630, a buffer circuit 1140, a second switch 450, and emission control circuit 261. Namely, the driving circuit 1800 may include both N-type and P-type transistors.

According to some embodiments of the disclosure, the driving circuit 1800 implemented by using both N-type and P-type transistors is merely exemplary, but not intended to be limited thereto. Each transistor in FIGS. 4, 6, 8, 10, 11, and 13-17 can be replaced with a N-type transistor or a P-type transistor and some proper modifications.

Figure 19:
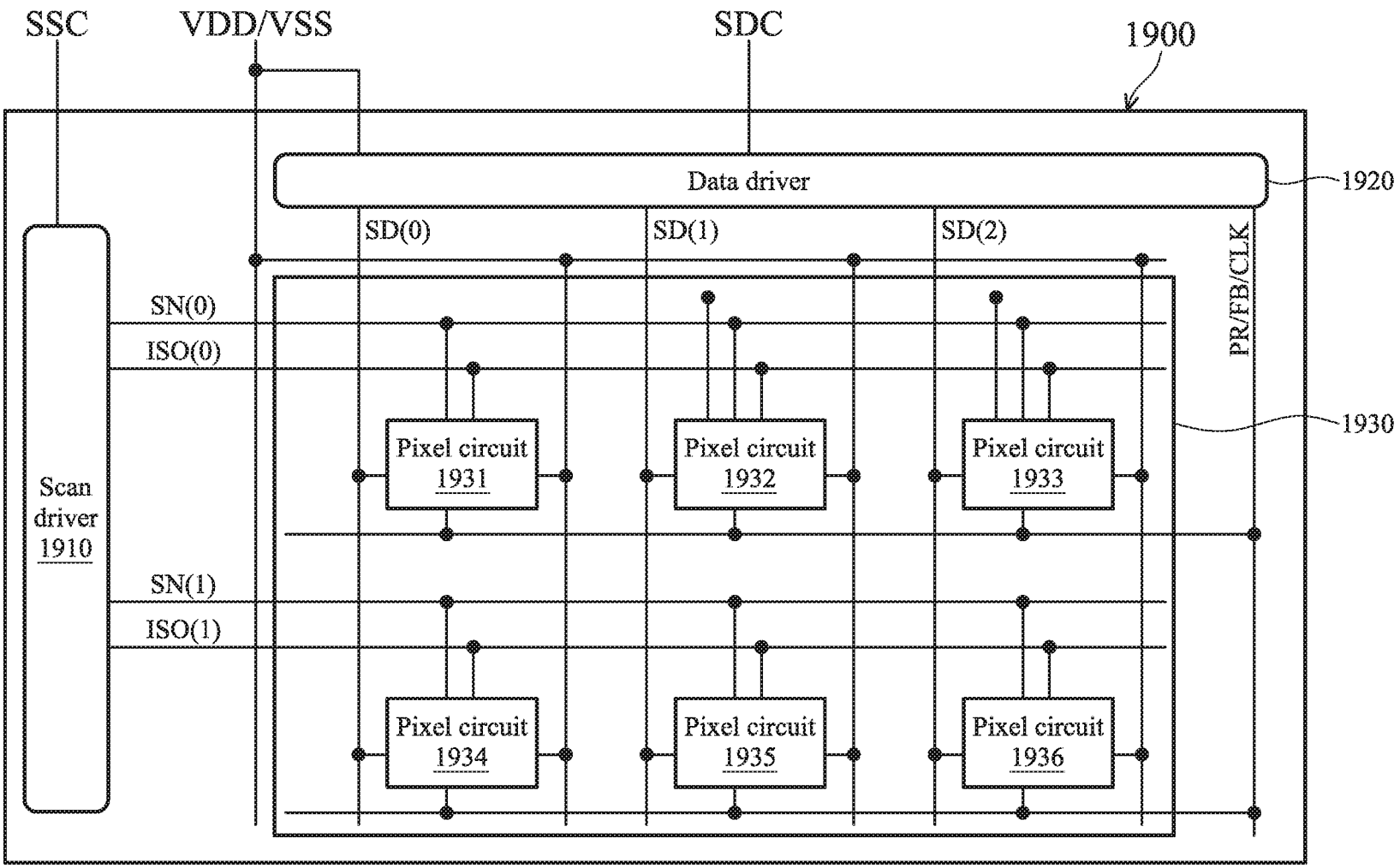
FIG. 19 illustrates a block diagram of a panel in accordance with an embodiment of the disclosure.

FIG. 19 illustrates a block diagram of a panel in accordance with an embodiment of the disclosure. As shown in FIG. 19, the panel 1900 includes a scan driver 1910, a data driver 1920, and an active area 1930. The scan driver 1910 receives the scan control signal SSC to generate scan signals SN(0), SN(1) and emission control signals ISO(0), ISO(1). According to some embodiments of the disclosure, the scan signals SN(0), SN(1) correspond to the scan signal SN in FIGS. 4, 6, 8, 10, 11, and 13-18.

The data driver 1920 receives the data control signal SDC to generate the data signals SD(0), SD(1), SD(2). And the aforementioned preset signal PR, the feedback signal FB, the clock signal CLK, and the enable signal EN can be generated from scan driver, data driver or other signal sources respectively.

The active area 1930 includes a plurality of pixel circuits 1931~1936, and each of the pixel circuit 1931~1936 corresponds to the driving circuit and the light emitting unit in the aforementioned embodiments. The supply voltage VDD and the ground level VSS are supplied to the data driver 1920 and the pixel circuits 1931~936.

While the disclosure has been described by way of example and in terms of preferred embodiment, it should be understood that the disclosure is not limited thereto. Those who are skilled in this technology can still make various combinations, alterations and modifications without departing from the scope and spirit of this disclosure. Therefore, the scope of the present disclosure shall be defined and protected by the following claims and their equivalents.

What is claimed is:

1. A driving circuit for driving a light emitting unit, comprising:

a data memory circuit, receiving a data signal;

a current source, generating a driving current;

a PWM control circuit, generating a PWM control signal, wherein the PWM control circuit comprises a plurality of first switches;

a buffer circuit, generating a PWM signal according to the PWM control signal; and a second switch, coupling the current source to the light emitting unit according to the PWM signal.

2. The driving circuit according to claim 1, wherein the data signal has N bits, wherein N is a positive integer.

3. The driving circuit according to claim 2, wherein the data memory circuit comprises N memory units and each of the memory units receives one bit of the data signal.

4. The driving circuit according to claim 1, wherein the buffer circuit comprises an input node for receiving the PWM control signal and an output node for outputting the PWM signal.

5. The driving circuit according to claim 4, wherein the buffer circuit further comprises a third switch coupling the output node to the input node according to a refresh signal.

6. The driving circuit according to claim 4, further comprising an emission control circuit coupling the output node to the second switch according to an emission control signal.

7. The driving circuit according to claim 4, wherein the buffer circuit comprises a bootstrap capacitor coupling to the output node.

8. The driving circuit of claim 4, further comprising:

an emission control circuit coupling the output node to the second switch according to an emission control signal.

9. The driving circuit of claim 8, wherein the emission control circuit comprises:

a seventh transistor, comprising a control terminal, a first terminal, and a second terminal, wherein the control terminal receives the emission control signal, the first terminal is coupled to the buffer circuit, and the second terminal is coupled to a second node; and an eighth transistor, comprising a control terminal, a first terminal, and a second terminal, wherein the control terminal is coupled to the second node, the first terminal receives the emission control signal, and the second terminal is coupled to the second node.

10. The driving circuit of claim 8, wherein the emission control circuit comprises:

a seventh transistor, comprising a control terminal, a first terminal, and a second terminal, wherein the control terminal receives the emission control signal, the first terminal is coupled to the buffer circuit, and the second terminal is coupled to the second node;

a ninth transistor, comprising a control terminal, a first terminal, and a second terminal, wherein the control terminal receives the emission control signal, the first terminal is coupled to the supply voltage, and the second terminal is coupled to a fourth node;

a tenth transistor, comprising a control terminal, a first terminal, and a second terminal, wherein the control terminal is coupled to the ground level, the first terminal is coupled to the fourth node, and the second terminal is coupled to the ground level; and an eleventh transistor, comprising a control terminal, a first terminal, and a second terminal, wherein the control terminal is coupled to the fourth node, the first terminal is coupled to the supply voltage, and the second terminal is coupled to the second node.

11. The driving circuit according to claim 1, wherein the driving circuit comprises only P-type or N-type transistors.

12. The driving circuit according to claim 1, wherein the driving circuit comprises both P-type and N-type transistors.

13. The driving circuit of claim 1, wherein the data memory unit comprises:

a first transistor, coupled between a data node and a storage node, wherein the first transistor passes the data signal from the data node to the storage node; and a first capacitor, coupled between the storage node and a ground level.

14. The driving circuit of claim 1, wherein the PWM control circuit comprises:

a plurality of transmission transistors, wherein at least one each of the plurality of transmission transistors passes a corresponding bit of the data signal to generate the PWM signal in response to a corresponding enable signal.

15. The driving circuit of claim 14, wherein durations of the enable signals are different from one another.

16. The driving circuit of claim 14, wherein the PWM control circuit comprises a second transistor coupled with a supply voltage.

17. The driving circuit of claim 1, wherein the buffer circuit comprises:

a third transistor, comprising a control terminal, a first terminal, and a second terminal, wherein the control terminal receives the PWM control signal, the first terminal is coupled to the supply voltage, and the second terminal is coupled to a first node;

a fourth transistor, comprising a control terminal, a first terminal, and a second terminal, wherein the control terminal is coupled to a ground level, the first terminal is coupled to the first node, and the second terminal is coupled to the ground level;

a fifth transistor, comprising a control terminal, a first terminal, and a second terminal, wherein the control terminal is coupled to the first node, the first terminal is coupled to the supply voltage, and the second terminal is coupled to the output node; and a sixth transistor, comprising a control terminal, a first terminal, and a second terminal, wherein the control terminal receives the PWM signal, the first terminal is coupled to the output node, and the second terminal is coupled to the ground level.

18. The driving circuit of claim 1, wherein the buffer circuit comprises:

a preset transistor, comprising a control terminal, a first terminal, and a second terminal, wherein the control terminal receives a preset signal, the first terminal is coupled to a supply voltage, and the second terminal is coupled to a first node;

a third transistor, comprising a control terminal, a first terminal, and a second terminal, wherein the control terminal receives the PWM control signal, the first terminal is coupled to the supply voltage, and the second terminal is coupled to the first node;

a fourth transistor, comprising a control terminal, a first terminal, and a second terminal, wherein the control terminal receives the preset signal, the first terminal is coupled to the first node, and the second terminal is coupled to a ground level;

a fifth transistor, comprising a control terminal, a first terminal, and a second terminal, wherein the control terminal is coupled to the first node, the first terminal is coupled to the supply voltage, and the second terminal is coupled to a output node;

a third switch, comprising a control terminal, a first terminal, and a second terminal, wherein the control terminal receives a feedback signal, the first terminal is coupled to a input node, and the second terminal is coupled to the output node;

a bootstrap transistor, comprising a control terminal, a first terminal, and a second terminal, wherein the control terminal is coupled to the ground level, the first terminal is coupled to the input node, and the second terminal is coupled to a bootstrap node;

a bootstrap capacitor, coupled between the bootstrap node and the output node; and a sixth transistor, comprising a control terminal, a first terminal, and a second terminal, wherein the control terminal is coupled to the bootstrap node, the first terminal is coupled to the output node, and the second terminal is coupled to the ground level.

19. The driving circuit of claim 1, wherein the buffer circuit comprises:

a third switch, comprising a control terminal, a first terminal, and a second terminal, wherein the control terminal receives a feedback signal, the first terminal is coupled to a input node, and the second terminal is coupled to a output node;

a bootstrap transistor, comprising a control terminal, a first terminal, and a second terminal, wherein the control terminal is coupled to a ground level, the first terminal is coupled to the input node, and the second terminal is coupled to a bootstrap node;

a bootstrap capacitor, coupled between the bootstrap node and the output node; and a sixth transistor, comprising a control terminal, a first terminal, and a second terminal, wherein the control terminal is coupled to the bootstrap node, the first terminal is coupled to the output node, and the second terminal receives a clock signal.

20. The driving circuit according to claim 1, wherein the light emitting unit is a LED.

* * * * *